US008712315B2

(12) United States Patent
Endoh et al.

(10) Patent No.: US 8,712,315 B2
(45) Date of Patent: Apr. 29, 2014

(54) IMAGE FORMING SYSTEM, PRINTING CONTROL METHOD, AND PROGRAM

(75) Inventors: Tsuyoshi Endoh, Kanagawa (JP); Tadashi Nagata, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 982 days.

(21) Appl. No.: 12/247,310

(22) Filed: Oct. 8, 2008

(65) Prior Publication Data

US 2009/0102110 A1 Apr. 23, 2009

(30) Foreign Application Priority Data

Oct. 17, 2007 (JP) ..... 2007-270547
Sep. 16, 2008 (JP) ..... 2008-237131

(51) Int. Cl.
*G03G 15/00* (2006.01)
*G03G 21/00* (2006.01)

(52) U.S. Cl.
USPC ..... 399/408

(58) Field of Classification Search
USPC ..... 399/407–411
See application file for complete search history.

(56) References Cited

U.S. PATENT DOCUMENTS

2005/0147441 A1* 7/2005 Van Bever ..... 400/70
2008/0172302 A1* 7/2008 Knodt ..... 705/26

FOREIGN PATENT DOCUMENTS

JP 11085419 A * 3/1999 ..... G06F 3/12
JP 2000-036901 2/2000
JP 2001-205857 7/2001
JP 2001205857 A * 7/2001 ..... G03G 21/00
JP 2003-274144 9/2003
JP 2004330602 A * 11/2004 ..... B41J 21/00
JP 2005022175 A * 1/2005 ..... G03G 15/00
JP 2006027259 A * 2/2006 ..... G06F 3/12
JP 2006240304 A * 9/2006 ..... B41J 11/42
JP 2007234037 A * 9/2007 ..... G06F 3/12
JP 2008281623 A * 11/2008 ..... G03G 21/00

* cited by examiner

*Primary Examiner* — Nguyen Ha
(74) *Attorney, Agent, or Firm* — IPUSA, PLLC

(57) ABSTRACT

An image forming system includes a printing unit which prints an image on a recording sheet and a wrap bookbinding unit which performs wrap bookbinding of a batch of recording sheets including a plurality of document sheets on which images are printed by the printing unit. In the image forming system, a thickness detection unit detects a thickness of the batch of recording sheets. A wrap bookbinding control unit causes, when the detected thickness of the batch of recording sheets exceeds a thickness threshold value, the wrap bookbinding unit to perform wrap bookbinding to create two or more volumes. A relevant information printing control unit causes the printing unit to print an image of relevant information, indicating a relationship of the two or more volumes, on a cover sheet used to wrap each volume.

10 Claims, 22 Drawing Sheets

FIG.9

| | |
|---|---|
| 1 | DR MINUTES |
| 2 | DR MINUTES |
| 3 | DR MINUTES |
| 4 | DR MINUTES |
| 5 | DR MINUTES |

FIG.10

| | |
|---|---|
| 1 | REGULAR MEETING REPORT |
| 2 | REGULAR MEETING REPORT |
| 3 | REGULAR MEETING REPORT |
| 4 | REGULAR MEETING REPORT |
| 5 | |

FIG.11

| | | | | |
|---|---|---|---|---|
| OPERATION PROCEDURE | OPERATION PROCEDURE | OPERATION PROCEDURE | OPERATION PROCEDURE | OPERATION PROCEDURE |
| | | 1-3 | 2-2 | |
| 1-1 | 1-2 | 2-1 | 3 | 4 |

FIG.21A
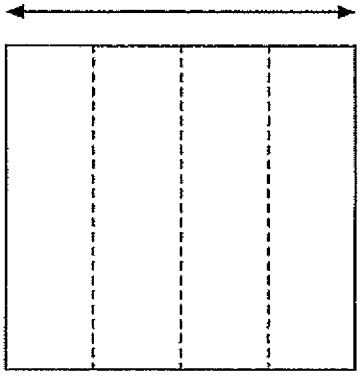
FIG.21B
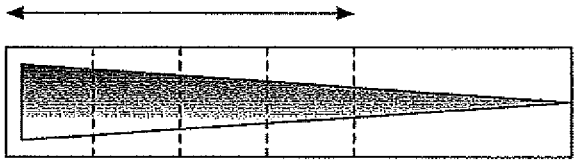
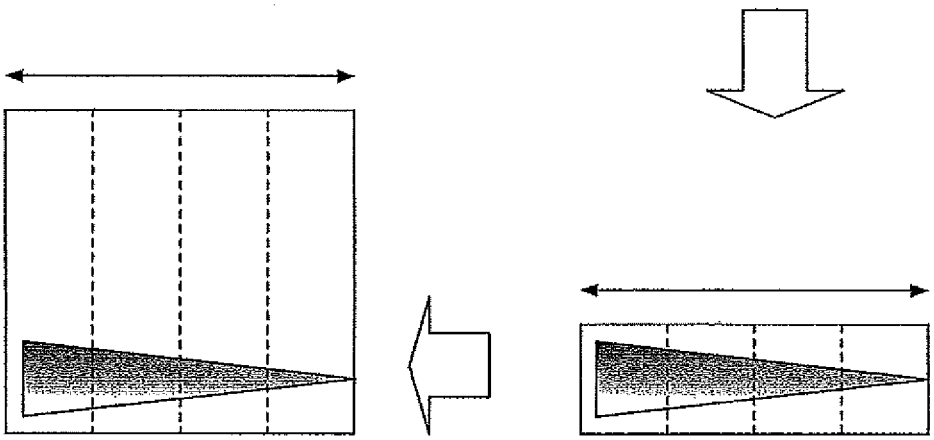
FIG.21D
FIG.21C

FIG.22A
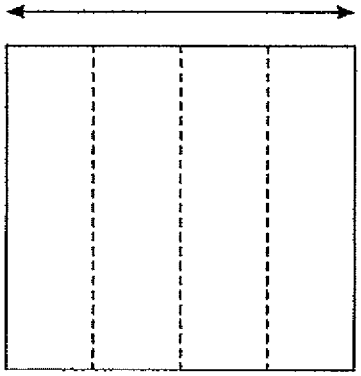
FIG.22B
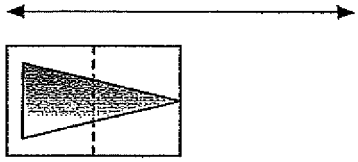
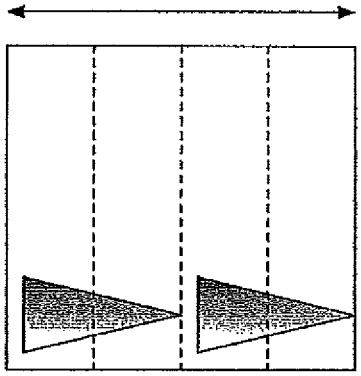
FIG.22C

FIG.23A
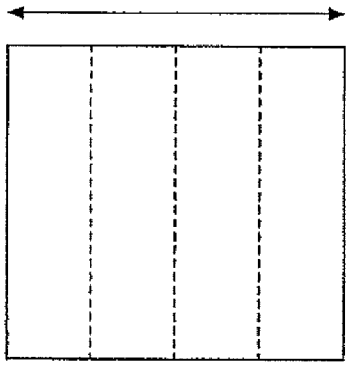
FIG.23B
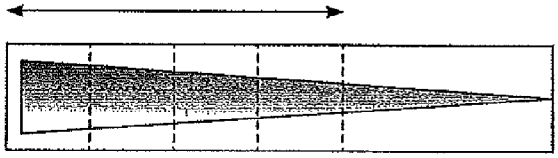
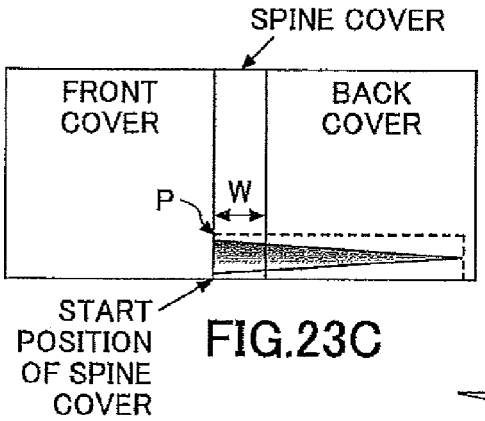
FIG.23C
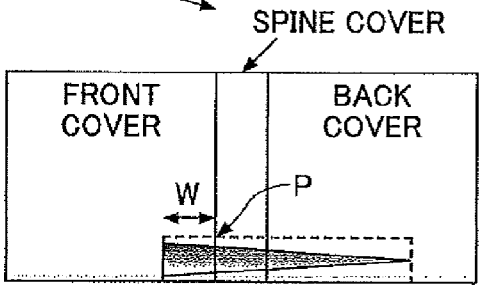
FIG.23D
FIG.23E
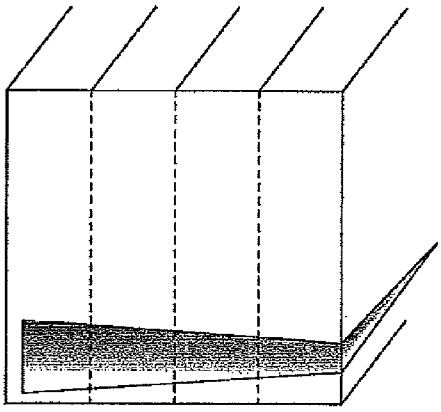

IMAGE FORMING SYSTEM, PRINTING CONTROL METHOD, AND PROGRAM

BACKGROUND OF THE INVENTION

1. Field of the Invention

This invention relates to an image forming system including an image forming device and a wrap bookbinding device which is a post-processing device of the image forming device, and relates to a printing control method and a program for use in the image forming system.

2. Description of the Related Art

There are some post-processing devices (finishers) of image forming devices which have various functions to be in conformity with the user's needs. Among such devices, there is known a wrap bookbinding device which creates separate volumes from an original document. In each of the volumes created, a batch of recording sheets on which the text is printed is arranged, paste is applied to the back of the batch, the front, the spine, and the back of the batch are wrapped with a cover sheet including a front cover, a spine cover, and a back cover, and the back of the batch is bonded to the back of the spine cover.

Japanese Laid-Open Patent Application No. 2001-205857 discloses an image forming system in which a cover including a front cover, a spine cover, and a back cover is produced concurrently with the time of printing of the text, the width of the spine cover is computed in accordance with the thickness (or width) of a batch of document sheets and the number of prints thereof, and the width (or size) of each of the front cover and the back cover is equal to the width (or size) of a document sheet.

In this manner, it is necessary that the width of a cover sheet used in the wrap bookbinding is as large as a sum of the double of the width of a document sheet and the width of a spine cover.

Conversely, in an image forming device using standard-sized sheets, the thickness of a batch of recording sheets which can be wrapped in the wrap bookbinding is considerably restricted by the size of the recording sheet used.

As disclosed in Japanese Laid-Open Patent Application No. 2001-205857, the image forming system in which the maximum sheet size is the enlarged A3 size (305 mm×457 mm), the size of a document sheet which can be wrapped with a cover of a recording sheet having the maximum sheet size is limited to A4, B5, etc. Moreover, when the document sheet used in this image forming system is of the A4 size, the width of a spine cover must be smaller than 37 mm (=457 mm−2×210 mm).

For this reason, when the thickness of a batch of recording sheets exceeds 37 mm, it is impossible to output a single volume from the original document as desired by the user. To avoid the problem, it is conceivable that the original document is divided into separate volumes and the volumes are output.

However, if the volumes are simply created, the relationship of the volumes is not apparent from the appearance thereof, and it is difficult to provide ease of inspection for the volumes.

SUMMARY OF THE INVENTION

In one aspect of the invention, the present disclosure provides an improved image forming system in which the above-described problems are eliminated.

In one aspect of the invention, the present disclosure provides an image forming system which is capable of clarifying the relationship of the volumes created by wrap bookbinding, and improving the ease of inspection for the volumes.

In an embodiment of the invention which solves or reduces one or more of the above-mentioned problems, the present disclosure provides an image forming system including a printing unit which prints an image on a recording sheet, and a wrap bookbinding unit which performs wrap bookbinding of a batch of recording sheets including a plurality of document sheets on which images are printed by the printing unit, the image forming system comprising: a thickness detection unit configured to detect a thickness of the batch of recording sheets; a wrap bookbinding control unit configured to cause, when the thickness of the batch of recording sheets detected by the thickness detection unit exceeds a thickness threshold value, the wrap bookbinding unit to perform wrap bookbinding to create two or more volumes; and a relevant information printing control unit configured to cause the printing unit to print an image of relevant information, indicating a relationship of the two or more volumes, on a cover sheet used to wrap each volume.

In an embodiment of the invention which solves or reduces one or more of the above-mentioned problems, the present disclosure provides a printing control method for use in an image forming system including a printing unit which prints an image on a recording sheet, and a wrap bookbinding unit which performs wrap bookbinding of a batch of recording sheets including a plurality of document sheets on which images are printed by the printing unit, the printing control method comprising the steps of: detecting a thickness of the batch of recording sheets; causing, when the detected thickness of the batch of recording sheets exceeds a thickness threshold value, the wrap bookbinding unit to perform wrap bookbinding to create two or more volumes; and causing the printing unit to print an image of relevant information, indicating a relationship of the two or more volumes, on a cover sheet used to wrap each volume.

In an embodiment of the invention which solves or reduces one or more of the above-mentioned problems, the present disclosure provides a computer-readable recording medium storing a computer-readable program which, when executed by a computer of an image forming system, causes the computer to perform a printing control method, the image forming system including a printing unit which prints an image on a recording sheet, and a wrap bookbinding unit which performs wrap bookbinding of a batch of recording sheets including a plurality of document sheets on which images are printed by the printing unit, the printing control method comprising the steps of: detecting a thickness of the batch of recording sheets; causing, when the detected thickness of the batch of recording sheets exceeds a thickness threshold value, the wrap bookbinding unit to perform wrap bookbinding to create two or more volumes; and causing the printing unit to print an image of relevant information, indicating a relationship of the two or more volumes, on a cover sheet used to wrap each volume.

According to the image forming system of the embodiment of the invention, when creating separate volumes by wrap bookbinding, the relationship of the volumes created can be clarified and the ease of inspection for the volumes can be improved.

Other objects, features and advantages of the present invention will become more apparent from the following detailed description when read in conjunction with the accompanying drawings.

BRIEF DESCRIPTION OF THE DRAWINGS

FIG. 9 is a diagram showing volumes in which the title and the volume number are printed on the spine covers by the image forming system of the present embodiment.

FIG. 10 is a diagram showing a thin volume in which the title is not printed on the spine but the volume number is printed by the image forming system of the present embodiment.

FIG. 11 is a diagram showing volumes in which the title, the volume number, and the chapter number are printed on the spine covers by the image forming system of the present embodiment.

FIG. 21A, FIG. 21B, FIG. 21C and FIG. 21D are diagrams showing an example in which an image is reduced and printed on spine covers.

FIG. 22A, FIG. 22B and FIG. 22C are diagrams showing an example in which an image is printed on spine covers repeatedly.

FIG. 23A, FIG. 23B, FIG. 23C, FIG. 23D and FIG. 23E are diagrams showing an example in which the printing position of an image is shifted and the image is printed on spine covers.

DETAILED DESCRIPTION OF THE PREFERRED EMBODIMENTS

A description will be given of embodiments of the invention with reference to the accompanying drawings.

Figure 1:
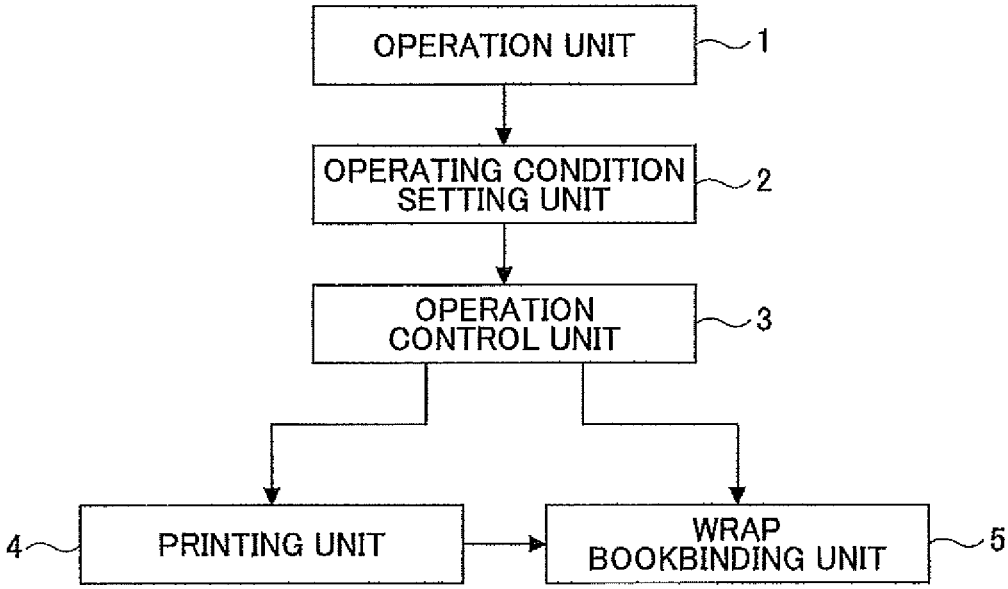
FIG. 1 is a block diagram showing the functional composition of an image forming system of an embodiment of the invention.

FIG. 1 shows the functional composition of an image forming system of an embodiment of the invention. The image forming system of this embodiment includes an image forming device and a post-processing device. The image forming device includes an operation unit 1, an operating condition setting unit 2, an operation control unit 3, and a printing unit 4. The post-processing device includes a wrap bookbinding unit 5 which is connected to both the operation control unit 3 and the printing unit 4.

The operation unit 1 includes a touch panel arranged in the housing of the image forming device, and a number of operation keys. The operation unit 1 is arranged to receive setting information or instructions input by an operator.

The operating condition setting unit 2 is configured by using a CPU and a memory (not shown) provided in the image forming device. The operating condition setting unit 2 is arranged to set operating conditions, including the operating mode of the image forming device and the operating mode of the wrap bookbinding unit 5 input by the operator from the operation unit 1, in the memory.

The operation control unit 3 is configured by using the CPU and the memory (not shown) provided in the image forming device. The operation control unit 3 controls operation of the printing unit 4 and the wrap bookbinding unit 5 in accordance with the operating conditions set by the operating condition setting unit 2.

The printing unit 4 has a function of printing the text of a document image or the like on a recording sheet with a predetermined size, and a function of printing a title of a document or the like on a cover which wraps a batch of document sheets in association with the wrap bookbinding unit 5.

Figure 2:
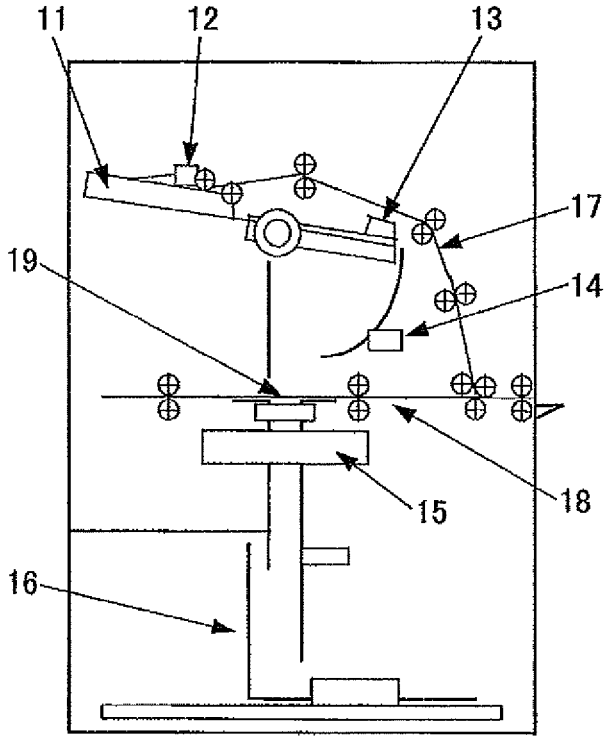
FIG. 2 is a diagram showing the composition of a wrap bookbinding unit shown in FIG. 1.

The wrap bookbinding unit 5 has the composition according to the related art as shown in FIG. 2. The wrap bookbinding unit 5 includes an accumulation tray 11, a sub-gripper 12, a main gripper 13, a pasting unit 14, a cutter 15, a loading tray 16, a document transport passage 17, and a cover transport passage 18.

The accumulation tray 11 is a tray for stacking a batch of recording sheets including a plurality of document sheets on which the text is printed by the printing unit 4.

The sub-gripper 12 detects a thickness of the batch of document sheets stacked on the accumulation tray 11.

The main gripper 13 transports the batch of document sheets from the accumulation tray 11 through the pasting unit 14 to the position 19 where the batch of document sheets and a cover sheet are bonded together.

The pasting unit 14 applies the glue to the back of the batch of document sheets transported by the main gripper 13.

When the width of a cover sheet transported from the cover transport passage 18 is too large for wrapping the batch of document sheets, the cutter 15 cuts the cover sheet into sheet pieces with a suitable width.

The loading tray 16 is a tray for accumulating the products (volumes) created by the wrap bookbinding device.

The document transport passage 17 is a transport passage of the batch of document sheets transported by the main gripper 13, and the cover transport passage 18 is a transport passage of a cover sheet.

Operation of the image forming system of this embodiment will be described.

Figure 3:
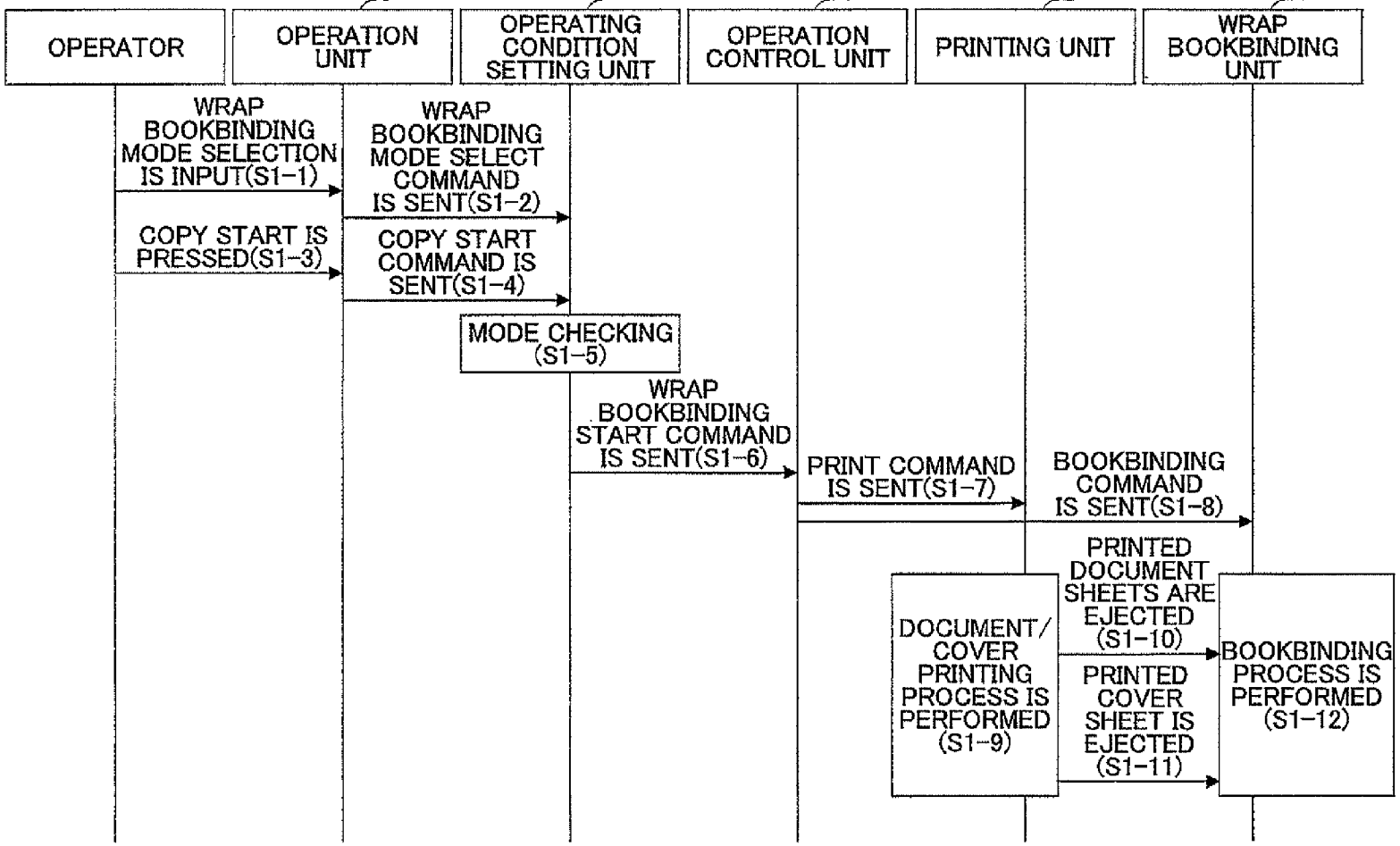
FIG. 3 is a sequence diagram for explaining the operation of the image forming system of the present embodiment.

FIG. 3 is a sequence diagram for explaining the operation of the image forming system of this embodiment.

Figure 4:
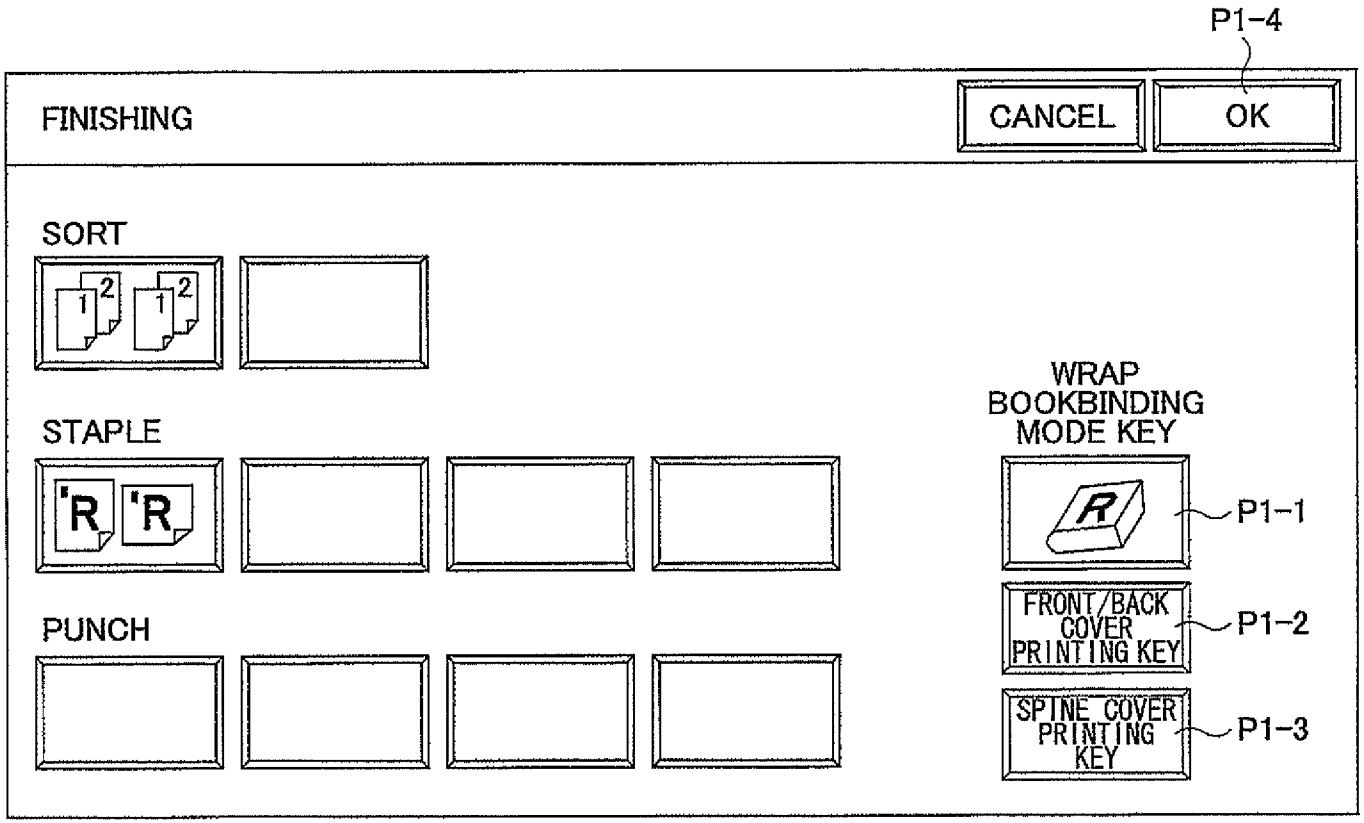
FIG. 4 is a diagram showing a finishing screen of the image forming system of the present embodiment.

First, in step S1-1, an operator presses a wrap bookbinding mode key P1-1 in a finishing screen (FIG. 4) provided by the operation unit 1, to send a request for selecting the wrap bookbinding mode to the operation unit 1.

Figure 5:
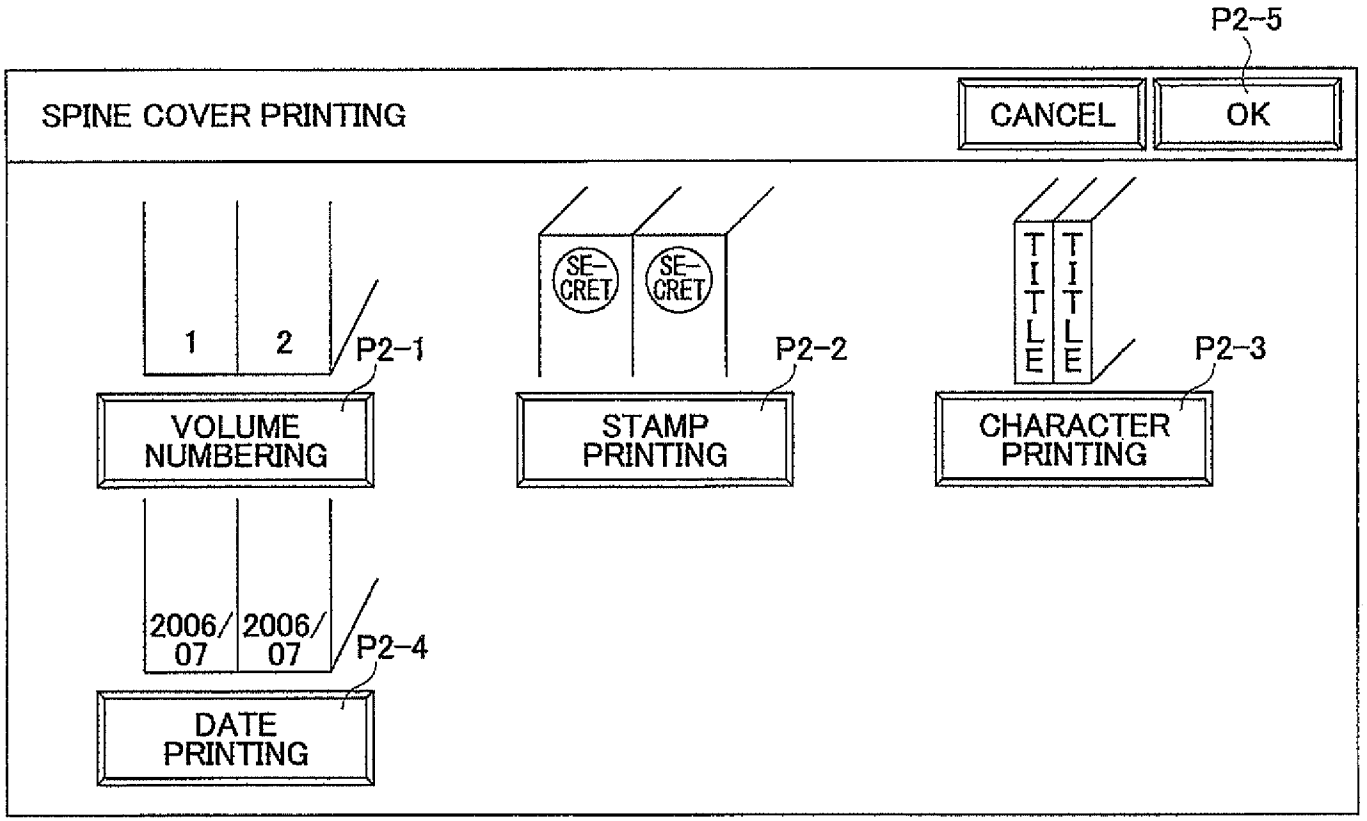
FIG. 5 is a diagram showing a spine cover printing screen of the image forming system of the present embodiment.

If the operator presses a front/back cover printing key P1-2 and a spine cover printing key P1-3 also at this time, the operation allows various items of information to be printed to a front cover, a back cover, and a spine cover. For example, if the spine cover printing key P1-3 is pressed, the spine cover printing screen shown in FIG. 5 is displayed. Any of various items of information can be printed by pressing one of a stamp printing key P2-2, a character printing key P2-3, and a date printing key P2-4 in the spine cover printing screen. A confirmation of the spine cover printing mode is sent to the operation unit 1 by pressing an OK key P2-5. With respect to the front cover and the back cover, a similar operation can be requested by the operator.

When the OK key P2-5 is pressed again, the display screen is returned to the finishing screen. If the operator presses the OK key P1-4 in the finishing screen, the operation allows a confirmation of the finishing mode to be sent to the operation unit 1.

In step S1-2, the operation unit 1 sends a wrap bookbinding mode select command to the operating condition setting unit 2.

In step S1-3, the operator presses the copy start key (not shown) and sends a copy start command to the operation unit 1.

In step S1-4, the operation unit 1 sends a copy start command to the operating condition setting unit 2.

In step S1-5, the operating condition setting unit 2 performs a mode checking to determine that the currently selected mode is the wrap bookbinding mode. In step S1-6, the operating condition setting unit 2 sends a wrap bookbinding start command to the operation control unit 3.

In step S1-7, the operation control unit 3 sends a print command for printing the text and the cover to the printing unit 4. Subsequently, in step S1-8, the operation control unit 3 sends a wrap bookbinding command to the wrap bookbinding unit 5.

In step S1-9, the printing unit 4 performs the printing of documents sheets and the printing of a cover sheet sequentially in response to the received print command.

In step S1-10, the printed document sheets are ejected and transported to the wrap bookbinding unit 5. In step S1-11, the printed cover sheet is ejected and transported to the wrap bookbinding unit 5. In step S1-12, the wrap bookbinding unit 5 performs a wrap bookbinding process in accordance with the wrap bookbinding command.

Figure 6B:
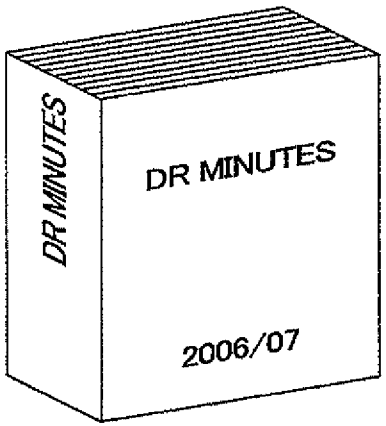
FIG. 6A and FIG. 6B are diagrams showing an example of a volume created by the wrap bookbinding unit of the image forming system of the present embodiment.
Figure 6A:
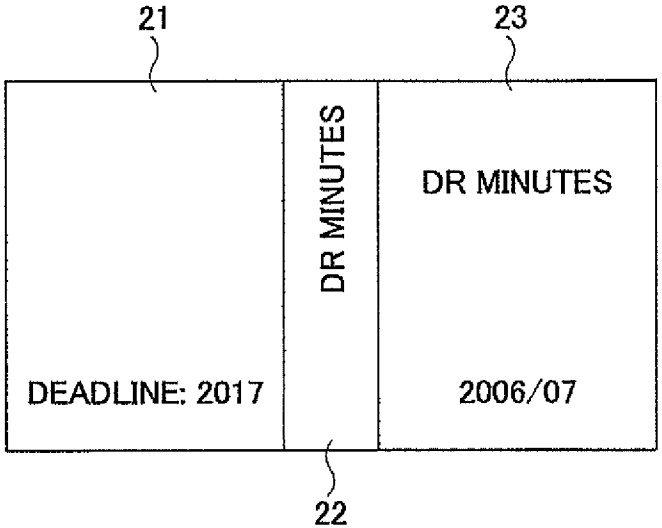

The above-mentioned steps are repeated until all the recording sheets are ejected. The product (a volume) as shown in FIGS. 6A and 6B can be obtained after the above-mentioned steps S1-1 to S1-12 are performed. FIG. 6A is a developed view of a volume, and FIG. 6B is a perspective view of the volume.

As shown in FIGS. 6A and 6B, "DEADLINE: 2017", the title "DR MINUTES", and the title and date "DR MINUTES 2006/07" are printed on a back cover 21, a spine cover 22, and a front cover 23, respectively.

The above-described operation is the basic operation. Next, the operation in the case of creating separate volumes will be described.

The steps S1-2 to S1-8 in the operation in the case of creating separate volumes are the same as corresponding steps of the basic operation of FIG. 3, and a description thereof will be omitted. A description will be given of only the steps S1-1 and S1-9 to S1-12 in the case of creating separate volumes which differ from the corresponding steps of the basic operation of FIG. 3. In the present embodiment, a volume number is printed as relevant information which indicates the relationship of the volumes created.

Figure 7:
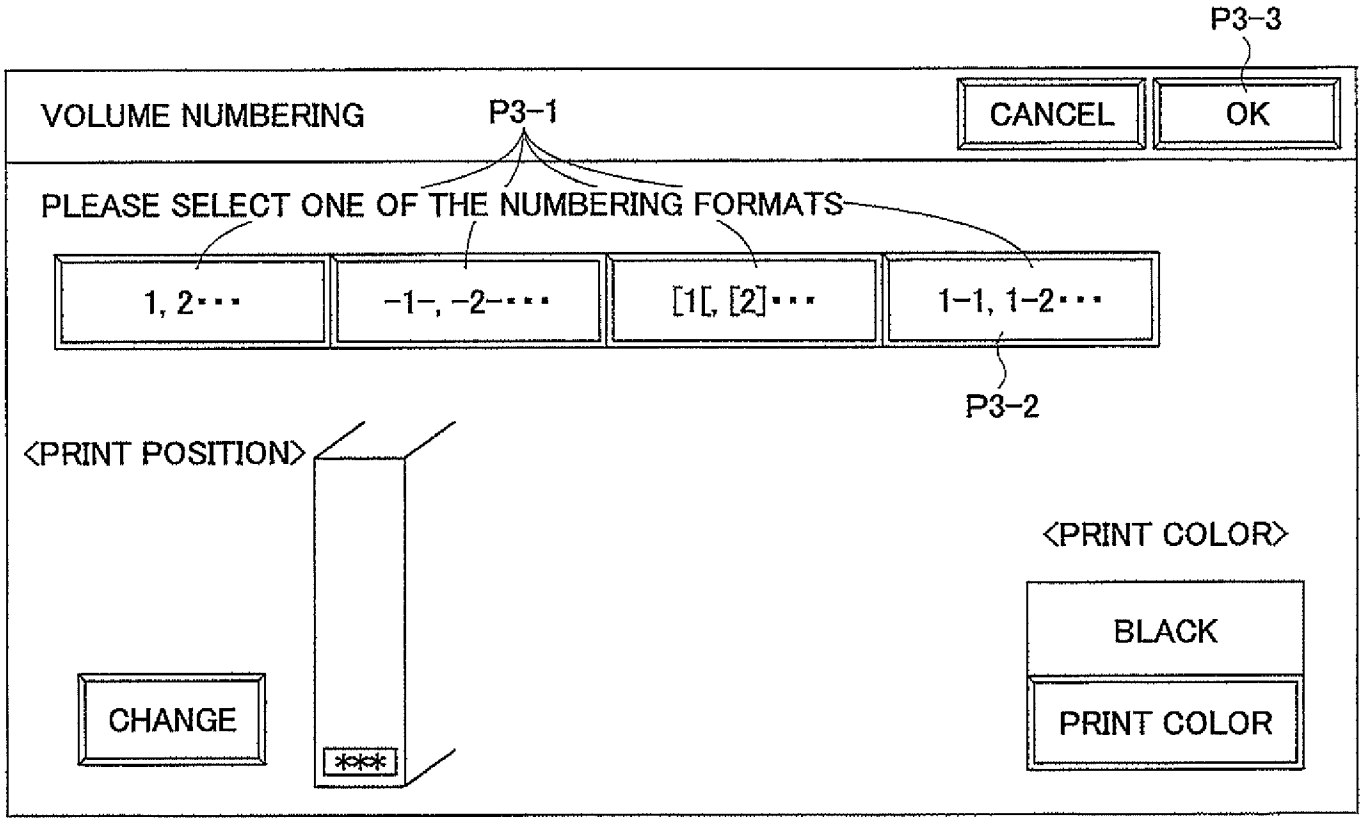
FIG. 7 is a diagram showing a volume numbering screen of the image forming system of the present embodiment.

In step S1-1, the operator presses the volume numbering key P2-1 in the spine cover printing screen shown in FIG. 5, and the volume numbering screen shown in FIG. 7 is displayed.

Subsequently, the operator presses the volume number printing format key P3-1 or P3-2 in the volume numbering screen, and this operation allows a command of printing of the volume number in any of various formats to be sent to the operation unit 1.

The volume number printing format key P3-1 is a key for selecting a printing format of only a volume number, and the volume number printing format key P3-2 is a key for selecting a printing format of a chapter number and a volume number when the chapter separation mode is set up.

Figure 8:
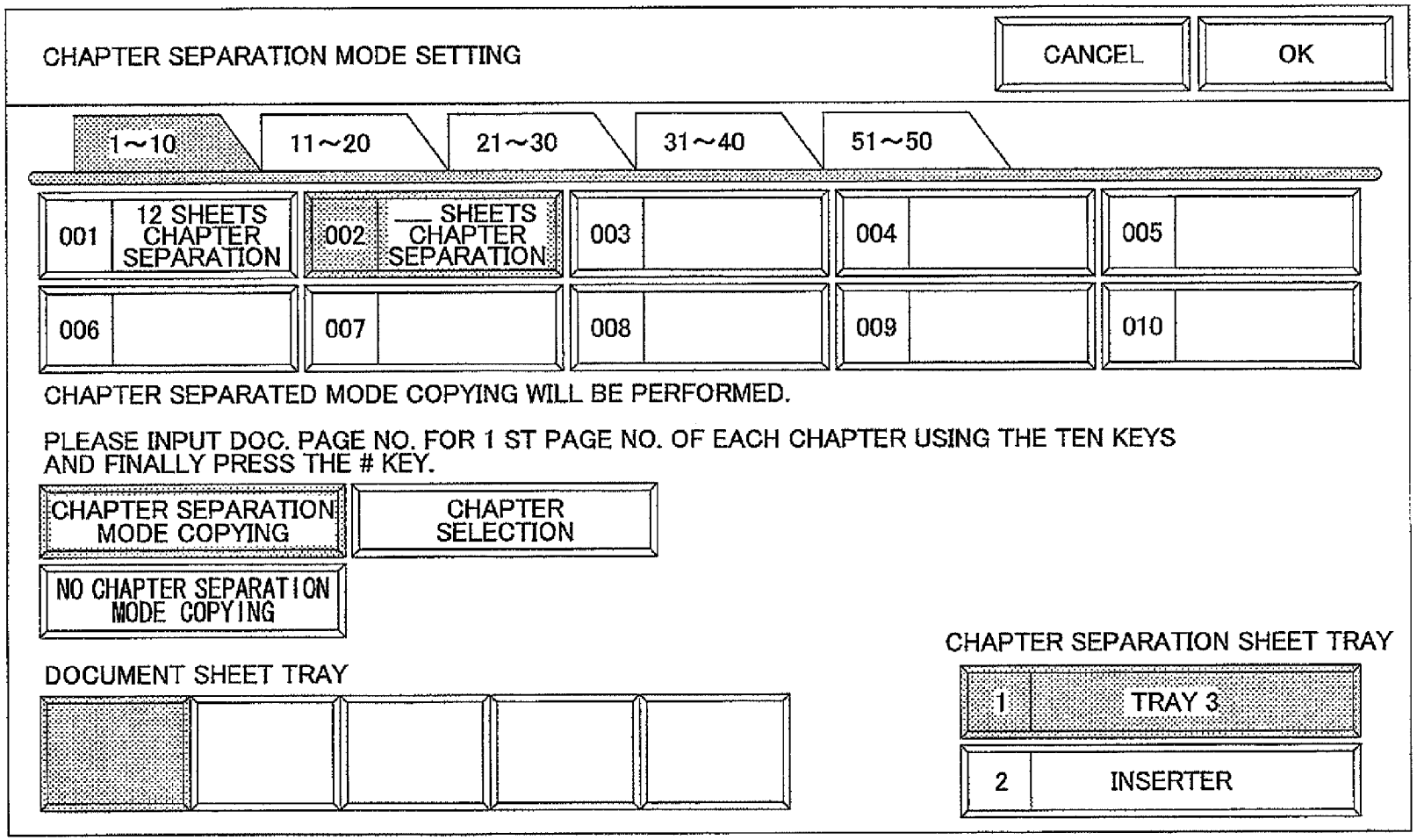
FIG. 8 is a diagram showing a chapter separation mode setting screen of the image forming system of the present embodiment.

FIG. 8 is a diagram showing an example of a chapter separation mode setting screen of the image forming system of this embodiment. In the screen of FIG. 8, two or more chapter setting buttons (the buttons 001-010) are provided, and, for every chapter setting button, the functions of selecting the chapter separation mode and of setting the number of sheets of a document may be input.

In the screen of FIG. 8, the state in which only the ten chapter setting buttons are provided is displayed. Alternatively, eleven or more chapter setting buttons may be displayed by pressing another tab in the screen of FIG. 8. Moreover, in the screen of FIG. 8, one of document sheet trays and one of chapter separation sheet trays may be selected.

Referring back to FIG. 7, the operator presses the OK key P3-3 to send a confirmation of the volume number printing format to the operation unit 1. At this time, the spine cover printing screen (FIG. 5) is displayed in response. The operator presses the OK key P2-5 to send a confirmation of the spine cover printing to the operation unit 1. The finishing screen (FIG. 4) is displayed in response. The operator presses the OK key P1-4 to send a confirmation of the finishing mode to the operation unit 1.

FIGS. 9-11 are diagrams showing examples of the volumes which are created by wrap bookbinding.

In the example of FIG. 9, the title "DR MINUTES" and one of the volume numbers "1" to "5" in ascending order are printed on each of the spine covers of the volumes.

In the example of FIG. 10, the title "REGULAR MEETING REPORT" and one of the volume numbers "1" to "4" in ascending order are printed on each of the spine covers of the volumes in which the thickness of the batch of documents sheets is larger than a predetermined title-character-size threshold, and the title is not printed on the spine cover of the volume in which the thickness of the batch of documents sheets is smaller than the above-mentioned threshold, but only the volume number "5" is printed.

In the example of FIG. 11, the title, the chapter number of chapters contained in the volume, and a volume number for each chapter if the chapter is divided into volumes are printed when the chapter separation mode is selected.

Next, the process which is performed by the operation control unit 3, the printing unit 4, and the wrap bookbinding unit 5 when creating the volumes shown in FIGS. 9 to 11 will be described with reference to FIGS. 12 to 15. This process represents the detailed procedure of the steps S1-9 to S1-12 of FIG. 3.

Figure 12:
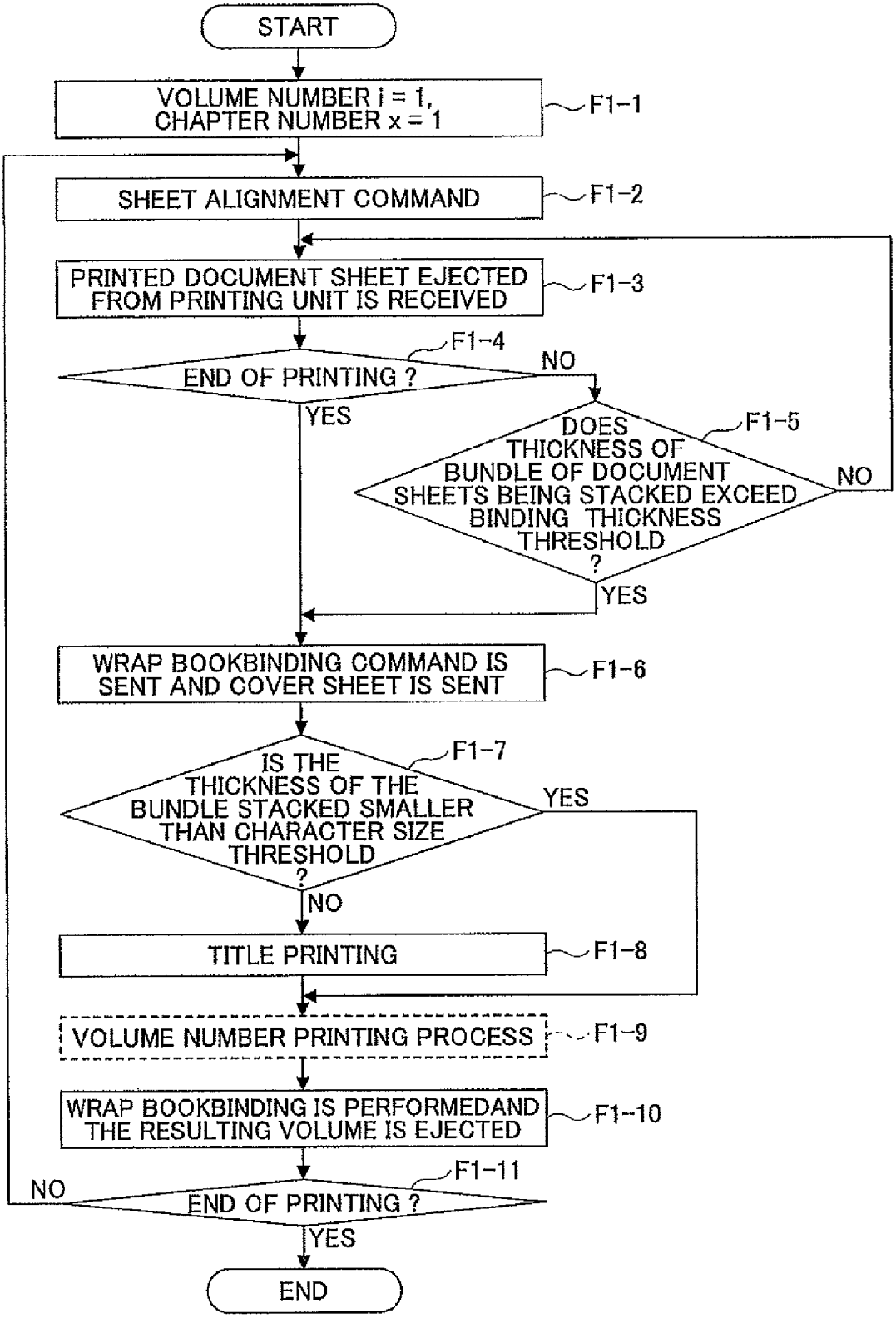
FIG. 12 is a flowchart for explaining a process performed by the image forming system of the present embodiment when creating separate volumes.

In step F1-1 of the process of FIG. 12, the operation control unit 3 initializes a volume number i and a chapter number x Both the initial values of the volume number i and the chapter number x are equal to "1".

In step F1-2, a sheet alignment command is sent to the wrap bookbinding unit 5 similar to the basic operation. In step F1-3, the printed document sheet ejected from the printing unit 4 is received.

In step F1-4, it is determined whether the end of printing of the document sheets occurs. When the end of printing occurs, a wrap bookbinding command and a cover sheet are sent to the wrap bookbinding unit 5 in step F1-6.

On the other hand, when the end of printing does not occur, the control progresses to step F1-5. In step F1-5, it is determined whether the thickness of the batch of the printed document sheets on the accumulation tray 11 of the wrap bookbinding unit 5 exceeds a predetermined binding thickness threshold.

When the result of the determination in the step F1-5 is negative, the control is returned to the step F1-3 in which the printed document sheet ejected from the printing unit 4 is received. When the result of the determination in the step F1-5 is affirmative, the control progresses to the step F1-6.

Namely, when the end of printing of all the document sheets occurs (F1-4: Yes), or when the thickness of the batch of the document sheets on the accumulation tray 11 exceeds the binding thickness threshold (F1-5: Yes), the output of the wrap bookbinding command and the cover sheet is performed (F1-6). Otherwise, the ejection/transport process of the document sheets is continuously performed.

After the output of the wrap bookbinding command and the cover sheet is performed, it is determined in step F1-7 whether the thickness of the batch of the document sheets stacked on the accumulation tray 11 is smaller than the predetermined title-character-size threshold. When the result of the determination in the step F1-7 is negative, the title printing is performed in step F1-8. The size of title characters printed on the spine cover must be a certain size and must be larger than the size of characters, such as a volume number, printed by the number printing function.

For this reason, when the thickness of the batch of document sheets is smaller than the title-character-size threshold, the width of the spine cover is too narrow and the printed title may overflow to a front cover or a back cover. To avoid the problem, the title printing is not performed in this case (see the volume 5 in FIG. 10).

Subsequently, in step F1-9, one of the following two processes is selectively performed depending on whether the printing format of only a volume number (the key P3-1 in FIG. 7) or the printing format of a chapter number and a volume number (the key P3-2) was selected in the above step S1-1 when the chapter separation mode is set up.

Figure 13:
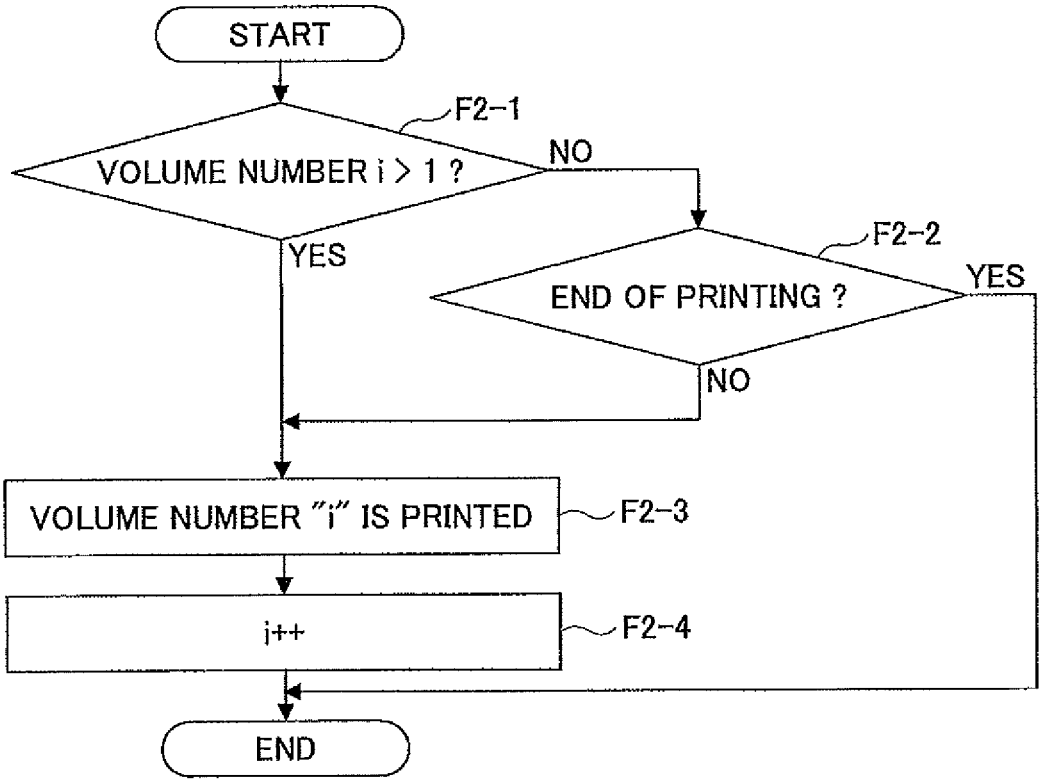
FIG. 13 is a flowchart for explaining a volume number printing process when only the volume number is printed in the process of FIG. 12.

FIG. 13 is a flowchart for explaining the process in which only the volume number i is printed in the process of FIG. 12.

As shown in FIG. 13, it is determined in step F2-1 whether the volume number i is larger than 1. When the volume number i is larger than 1, two or more volumes are created and the volume number i is printed in step F2-3.

On the other hand, when the volume number i is equal to 1, it is determined in step F2-2 whether the printing of the volume number is completed.

When the printing is completed, there is no separate volume and it is not necessary to print the volume number. Then, the process of FIG. 13 is terminated.

On the other hand, when the printing of the volume number is not completed, there is a separate volume and the volume number is printed in step F2-3, and the volume number i is incremented to the next volume number in step F2-4. Then, the process of FIG. 13 is terminated.

Figure 14:
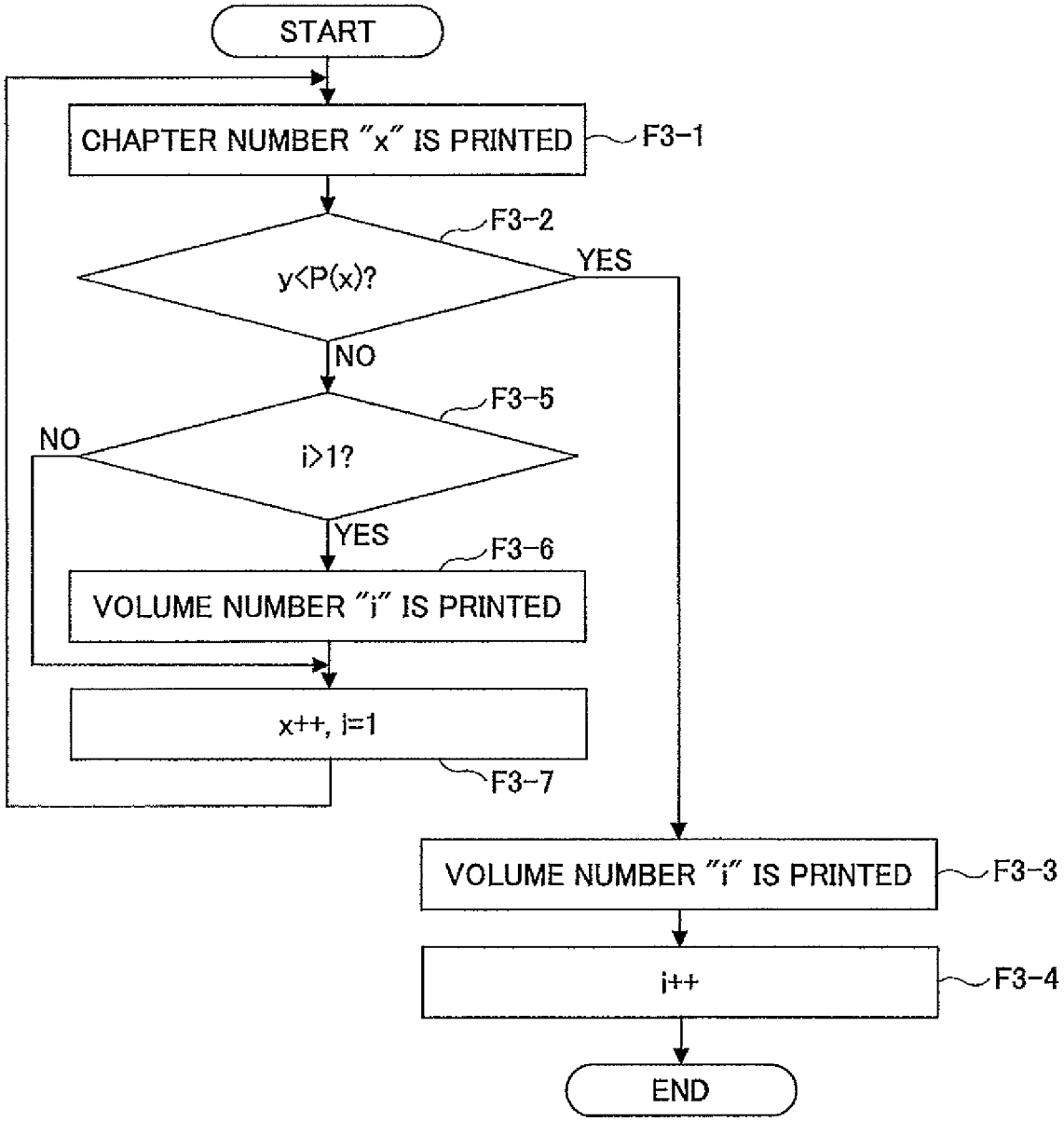
FIG. 14 is a flowchart for explaining the case in which the chapter number and the volume number are printed when a chapter separation mode is set in the process of FIG. 12.

FIG. 14 is a flowchart for explaining the process in which the chapter number x and the volume number i are printed when the chapter separation mode is set in the process of FIG. 12.

As shown in FIG. 14, in step F3-1, the chapter number x is printed.

Next, it is determined in step F3-2 whether the total number y of the recording sheets ejected to the accumulation tray 11 is smaller than the total number of pages P(x) up to Chapter x. For example, in the case of x=2, P(x)=P(2) (which indicates the total number of pages up to Chapter 2) means the sum of the number of pages of Chapter 1 and the number of pages of Chapter 2. For example, in the case where the second volume is ejected to the accumulation tray 11, the value of y indicates the sum of the number of recording sheets currently ejected to the accumulation tray 11 and the number of recording sheets of the first volume.

One of the following two processes (i) and (ii) is selectively performed depending on the result of the judgment in the step F3-2 (according to the relation between P(x) and y).

(i) In the case of y<P(x), the ejection of the recording sheets of Chapter x to the accumulation tray 11 has not been completed yet, and Chapter x is divided into two or more volumes. Therefore, after the volume number i is printed in step F3-3, and the volume number i is incremented to the number of the volume next to Chapter x in step F3-4.

For example, in the case of P(2)=110, y=100 and i=1, 10 pages (P(2)−y) of surplus sheets of Chapter 2 are not ejected to the accumulation tray 11 yet, and another volume will be created from these sheets. That is, it is finalized that Chapter 2 is divided into volumes. Thus, the volume number "1" is printed and the volume number is incremented to "2" for the following volume.

(ii) In the case of y≥P(x), the ejection of the recording sheet of Chapter x to the accumulation tray 11 is completed, and whether the volume number is to be printed or not depends on the value of the volume number i at this time. It is determined in step F3-5 whether the volume number i is larger than 1. When the volume number i is larger than 1, it is finalized that there is a separate volume, and the volume number i is printed in step F3-6.

On the other hand, when the volume number i is equal to 1, it is determined that chapter x is included in one volume, and the volume number i is not printed.

In any case, the ejection of chapter x is completed, and in step F3-7, the chapter number x is incremented and the volume number i is initialized for the following chapter (initial value=1).

Referring back to FIG. 12, after the printing of the cover is completed in the steps F1-7 to F1-9, the wrap bookbinding is performed and the resulting volume is ejected to the accumulation tray 16 in step F1-10.

Subsequently, in the step F1-11, it is determined whether the end of the printing of all the recording sheets occurs. When the printing is not completed, the control is returned to the step F1-2. When the end of the printing occurs, the process of FIG. 12 is terminated.

Here, the above-described process is summarized. When the printing format of only a volume number is chosen in the step S1-1 and the volume number i is repeatedly printed in the step F1-9, the resulting volumes are as shown in FIG. 9. However, the steps F1-7 and F1-8 are excluded.

On the other hand, when the printing format of a chapter number and a volume number is chosen for the time of the chapter separation mode in the step S1-1 and the chapter number and the volume number are repeatedly printed at the time of the chapter separation mode in the step F1-9, the resulting volumes are as shown in FIG. 11. In addition, when the steps F1-7 and F1-8 are performed, the resulting volumes are as shown in FIG. 10.

Figure 15:
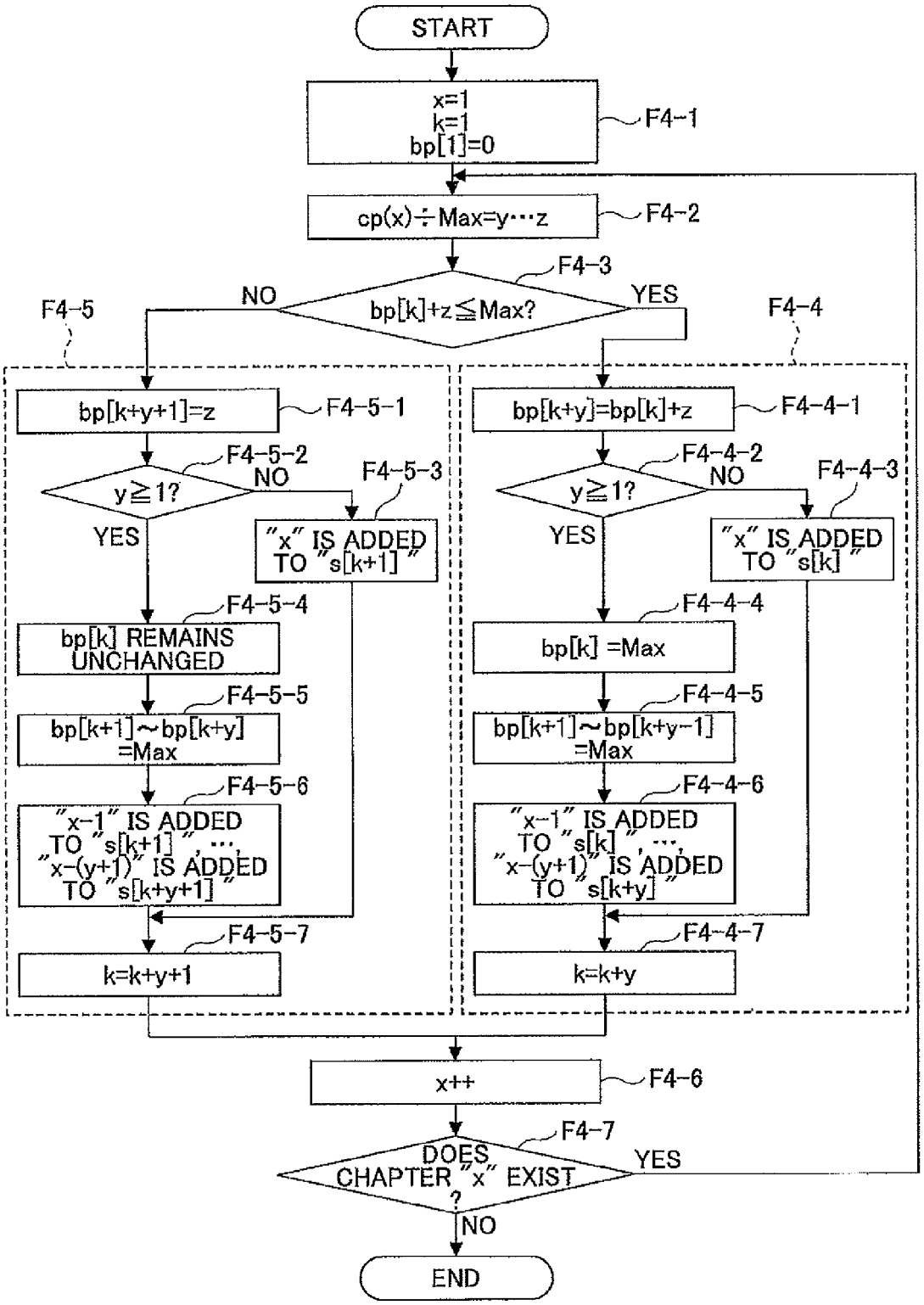
FIG. 15 is a flowchart for explaining a wrap bookbinding process performed by the image forming system of the present embodiment.

Next, FIG. 15 is a flowchart for explaining a wrap bookbinding process performed by the image forming system of the present embodiment which is arranged to prevent a volume containing a too small number of pages from being created.

The parameters for use in this process are defined as follows.

k: the volume for which the binding number of sheets or the characters being printed are currently computed is called k-th volume. It is supposed that the characters being printed and the binding number of sheets for the preceding volumes up to (k−1)-th volume are known.

cp(x): the number of pages of Chapter x

Max: the maximum binding number of sheets which can be created by the wrap bookbinding unit 5 bp[k]: the binding number of sheets of k-th volume s[k]: the character string being printed to k-th volume.

In step F4-1, the parameters x, k and bp[1] are initialized such that x=1, k=1, and bp[1]=0.

In step F4-2, the computation of "cp(x)/Max=y . . . z" is performed. And the quotient y when the number of pages of Chapter x is divided by the maximum binding number of sheets, and the remainder z (or the number z of surplus sheets in the volume which does not contain the maximum binding number of sheets) are obtained.

In step F4-3, it is determined whether the z surplus sheets can be included in the k-th volume (bp[k]+z≤Max?). Because bp[k] indicates the binding number of sheets of the k-th volume which is currently valid, when the result of the determination "bp[k]+z≤Max?" is affirmative, it is determined that the z surplus sheets can be included in the k-th volume.

When the result of the determination in the step F4-3 is affirmative, the control progresses to step F4-4 and the following steps are performed.

In step F4-4-1, in the case of bp[k]=0, bp[k+1] to bp[k+y−1] are equal to Max, and bp[k+y] is equal to z. However, in the case where bp[k] is a positive number (in which the recording sheets of the preceding chapter may be contained), it is determined in step F4-4-1 that bp[k+y] is equal to the sum of bp[k] and the remainder z (that is, bp[k+y]=bp[k]+z).

In step F4-4-2, it is determined whether y is equal to or larger than one. When y is equal to 1, the number of pages of Chapter x are included in one volume exactly. When y is larger than one, the number of pages of Chapter x exceeds Max and there are surplus sheets. In both cases, the control progress to step F4-4-4.

On the other hand, when y is smaller than one, the control progresses to step F4-4-3. In this case, the number of pages of Chapter x can be included in the k-th volume, and in step F4-4-3, "x" is added to s[k].

When y is equal to or larger than one, bp[k] (the binding number of sheets of the k-th volume) and bp[k+1] to bp[k+y−1] (the binding numbers of sheets of the (k+1)-th to (k+y−1)-th volumes) are set to Max (the maximum binding number of sheets) in steps F4-4-4 and F4-4-5.

Because the k-th to (k+y)-th volumes are created from Chapter x, "x−1" is added to s[k],. . . , "x−(y−1)" is added to s[k+y] in step F4-4-6, respectively.

In summary, the steps F4-4-1 to F4-4-6 are performed as follows.

The recording sheet of Chapter x as many as possible are added to the k-th volume, and the remaining recording sheets are added to the (k+1)-th volume. Therefore, bp[k] is equal to Max, and bp[k+1] to bp[k+y−1] are also equal to Max.

The case where only z is added to bp[k] is considered. In this case, bp[k+y] should be set to Max. However, because the recording sheets are actually added to bp[k] so that the sum is equal to Max, the sum of the value of bp[k+y] and the value of (Max−(bp[k]+z)) is equal to Max. Accordingly, the value of bp[k+y] is represented by the formula:

$$bp[k+y]=\text{Max}-(\text{Max}-(bp[k]+z))=bp[k]+z$$

Next, the characters being printed are determined depending on whether Chapter x is divided into two or more volumes.

The addition to the k-th volume is finalized in the determination of the step F4-3. When y is above one, the (k+1)-th or subsequent volume will be created. When no further volume is not created, only the chapter number x is printed. When a further volume is created, the chapter number x and the volume numbers 1 to (y+1) are printed.

In these steps, the characters being printed and the binding number of sheets for the volumes up to the (k+y−1)-th volume are finalized. The volume for which the binding number of sheets and the characters being printed are currently computed is set to the (k+y)-th volume. In step F4-4-7, k is set to (k+y) (k=k+y).

When it is determined in the step F4-3 that the z surplus sheets cannot be included in the k-th volume, the control progresses to step F4-5, and the following steps are performed.

In step F4-5-1, no surplus sheet is added to the k-th volume, and bp[k+1] to bp[k+y] are equal to Max. Therefore, the z surplus sheets will be added to the following (k+y+1)-th volume (bp[k+y+1]=z).

In step F4-5-2,-the procedure that is the same as in the step F4-4-2 is performed. It is determined whether y is equal to or larger than one.

When y is smaller than one in step F4-5-2, the number of pages of Chapter x can be included in the (k+1)-th volume, and in step F4-5-3, the chapter number "x" is added to the character string s[k+1] of the (k+1)-th volume.

When y is equal to or larger than one in step F4-5-2, the control progresses to step F4-5-4. Because it is determined in the step F4-3 that the z surplus sheets are not added to the k-th volume, nothing is added to the k-th volume and bp[k] remains unchanged in step F4-5-4.

In step F4-5-5, bp[k+1] to bp[k+y] (the binding numbers of sheets of the (k+1)-th to (k+y)-th volumes) are set to Max (the maximum binding number of sheets).

Because the (k+1)-th to (k+y+1)-th volumes are created from Chapter x, "x−1" is added to s[k+1], . . . , "x−(y+1)" is added to s[k+y+1] in step F4-5-6, respectively.

In the above steps, the characters being printed and the binding number of sheets for the volumes up to the (k+y)-th volume are finalized. The volume for which the binding number of sheets and the characters being printed are currently computer is set to the (k+y+1)-th volume. In step F4-5-7, k is set to (k+y+1) (k=k+y+1).

After the step F4-4 or F4-5, the value of x is incremented in step F4-6. And it is determined in step F4-7 whether the following chapter x (of the incremented value) exists. When the following chapter exists in step F4-7, the control is returned to the step F4-2 and the above steps F4-2 to F4-7 are repeated for the following chapter. When the following chapter does not exist in step F4-7, the process of FIG. 15 is terminated.

By the above-described steps F4-1 to F4-7, the binding number of sheets of each volume being created and the characters being printed are finalized. Therefore, each time the binding number of sheets determined for each volume is reached, the bookbinding is performed to create the volume and the determined characters are printed to the spine of the volume. It is possible for the present embodiment to print the volume number and the chapter number on the spine covers of the volumes so as to allow the relationship of the volumes to be easily recognized, and it is possible for the present embodiment to prevent a volume containing a too small number of pages from being created.

Next, an image forming system of another embodiment of the invention will be described.

In this embodiment, an image is used as relevant information that is relevant to the plurality of volumes created. As for the images the case where the image which is to be printed or pasted to the spine is read by the image forming system will be explained. Alternatively, the image already stored in the image forming system may be used, or when connected to a network, the image acquired via the network may be used.

In the image forming system of this embodiment, the image processing is performed as mentioned above, and a description of the image processing will be given. The image processing performed in the previous embodiment is essentially the same as that performed in this embodiment, which will be described below.

Figure 16:
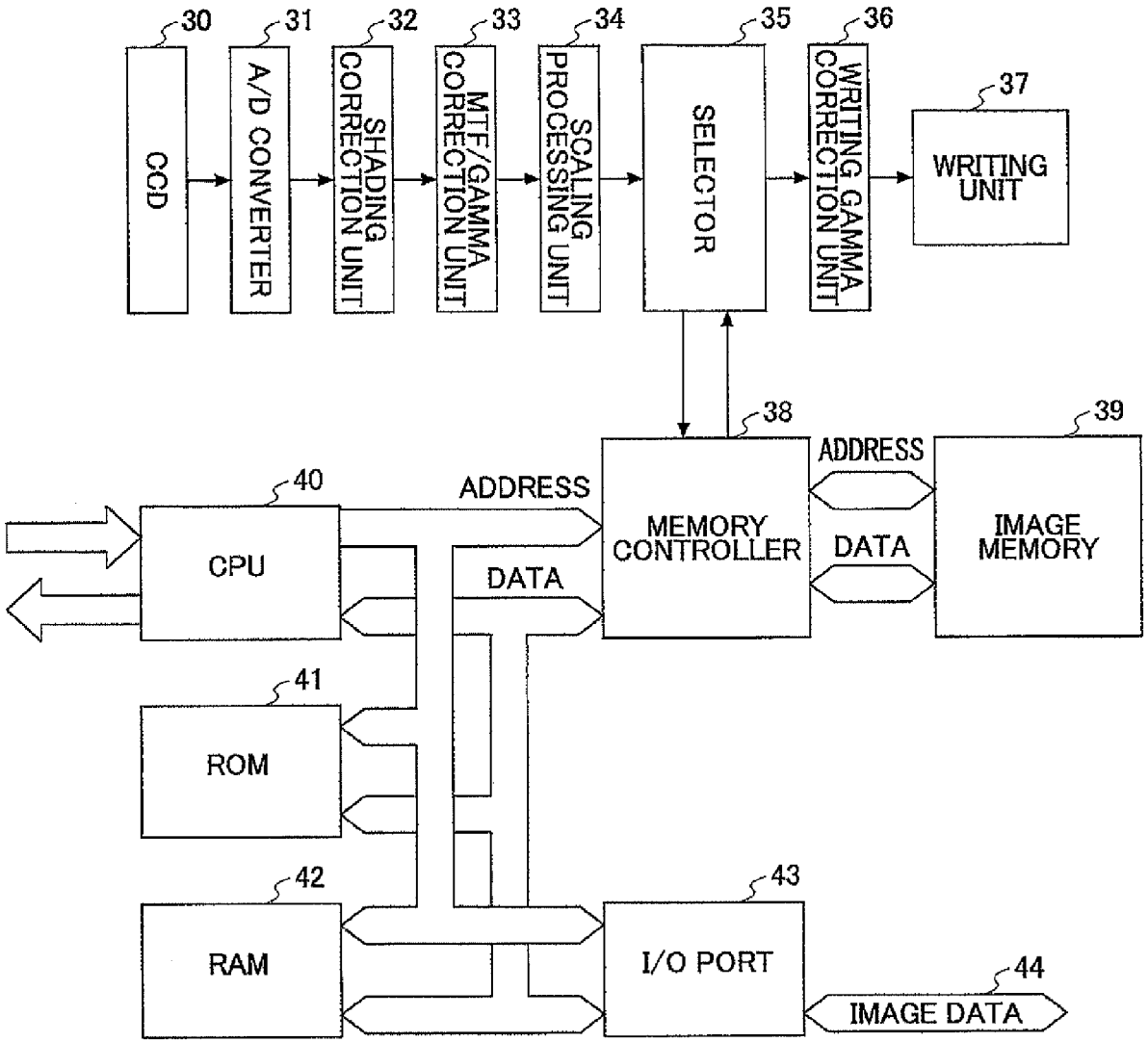
FIG. 16 is a block diagram showing the composition of an image-processing unit in an embodiment of the invention.

FIG. 16 is a block diagram showing the internal composition of an image-processing unit (IPU) in this embodiment.

In the image-processing unit of FIG. 16, a CCD camera 30 performs photoelectric conversion of a reflected light from the light irradiated from the exposure lamp. An A/D converter 31 converts the analog signal after the photoelectric conversion into a digital signal.

A shading correction unit 32 performs shading correction of the image signal which is the digital signal from the A/D converter 31. Then, an MTF/gamma correction unit 33 performs MTF correction, gamma correction, etc., of the image signal and outputs the image signal after the correction to a scaling processing unit 34.

The scaling processing unit 34 performs scaling of the image signal after the correction in accordance with to the scaling ratio. A selector 35 selects one of a writing gamma correction unit 36 and a memory controller 38 as the destination of the image signal.

The writing gamma correction unit 36 performs gamma correction of the image signal in accordance with the imaging conditions, and outputs the resulting signal to the writing unit 37. The composition between the memory controller 38 and the selector 35 is arranged so that the image signal can be output and input bidirectionally.

A CPU 40 performs setting of the memory controller 38 and performs control of reading and writing the memory, etc. A ROM 41 and a RAM 42 store the program and the data for controlling the CPU 40. The CPU 40 performs writing of data to or reading of the data from an image memory 39 through the memory controller 38.

The image data of the document image is sent to the memory controller 38, the image data is compressed by the image compression device in the memory controller, and the compressed image data is sent to the image memory 39.

The reason for performing the image data compression is to make effective use of the available storage capacity of the image memory 39. If the image data of 256 gray-scale levels for the maximum image size is written to the image memory 39 without compression, the image data of a document image of one sheet will consume a large amount of the storage capacity of the image memory 39. The storage capacity of the image memory 39 is restricted, and it can be used effectively by performing the image data compression.

The image stored in the image memory 39 can be accessed by the CPU 40. For this reason, it is possible to process the image stored in the image memory 39. For example, an image skip process, an image logging process, etc. can be performed by the CPU 40. In order to process the image stored in the image memory 39, the image data can be written to the register of the memory controller 38. The processed image is stored again in the image memory 39.

When the size of the image data to be processed is large, the image memory 39 is divided into a plurality of areas, and the inputting/outputting of the image data can be performed simultaneously. In order to perform the inputting/outputting of the image data in parallel in the divided areas, 2 sets of address data lines for reading and for writing are connected between the image memory 39 and the memory controller 38. Thereby, the read/write operation which outputs image data from an area 1 of the image memory 39 (reading) while inputting the image data to an area 2 of the image memory 39 (writing) is possible.

Figure 17:
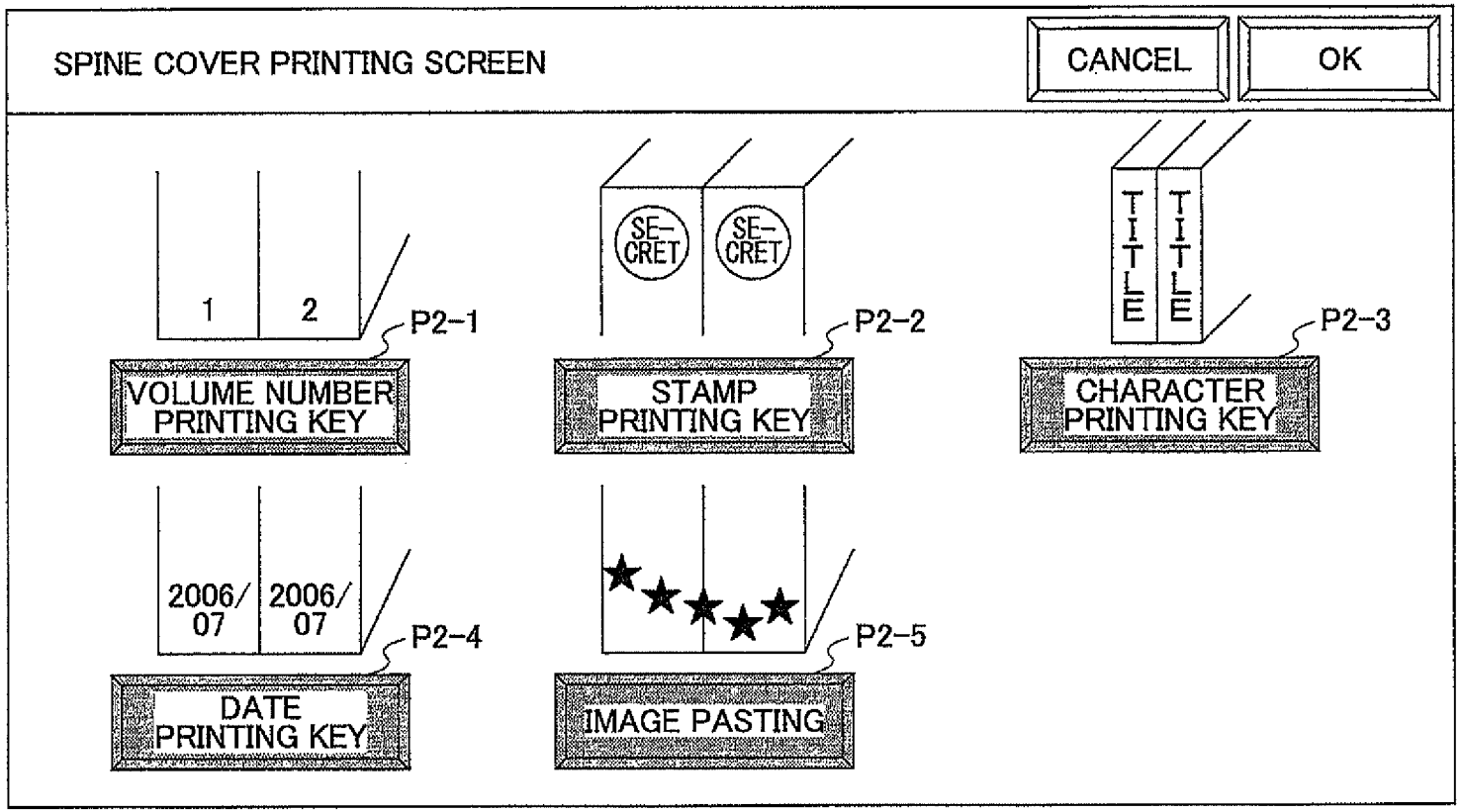
FIG. 17 is a diagram showing a spine cover printing screen of the image forming system of the present embodiment.

FIG. 17 is a diagram showing the spine cover printing screen of the image forming system of this embodiment.

As shown in FIG. 17, an image paste key P2-5 is added to the selection key of the spine cover printing screen shown in FIG. 5. Hereafter, the case where the image paste key P2-5 is pressed by the operator (selection) will be explained. If the image paste key P2-5 is chosen, the display screen is changed to the image paste screen.

Figure 18:
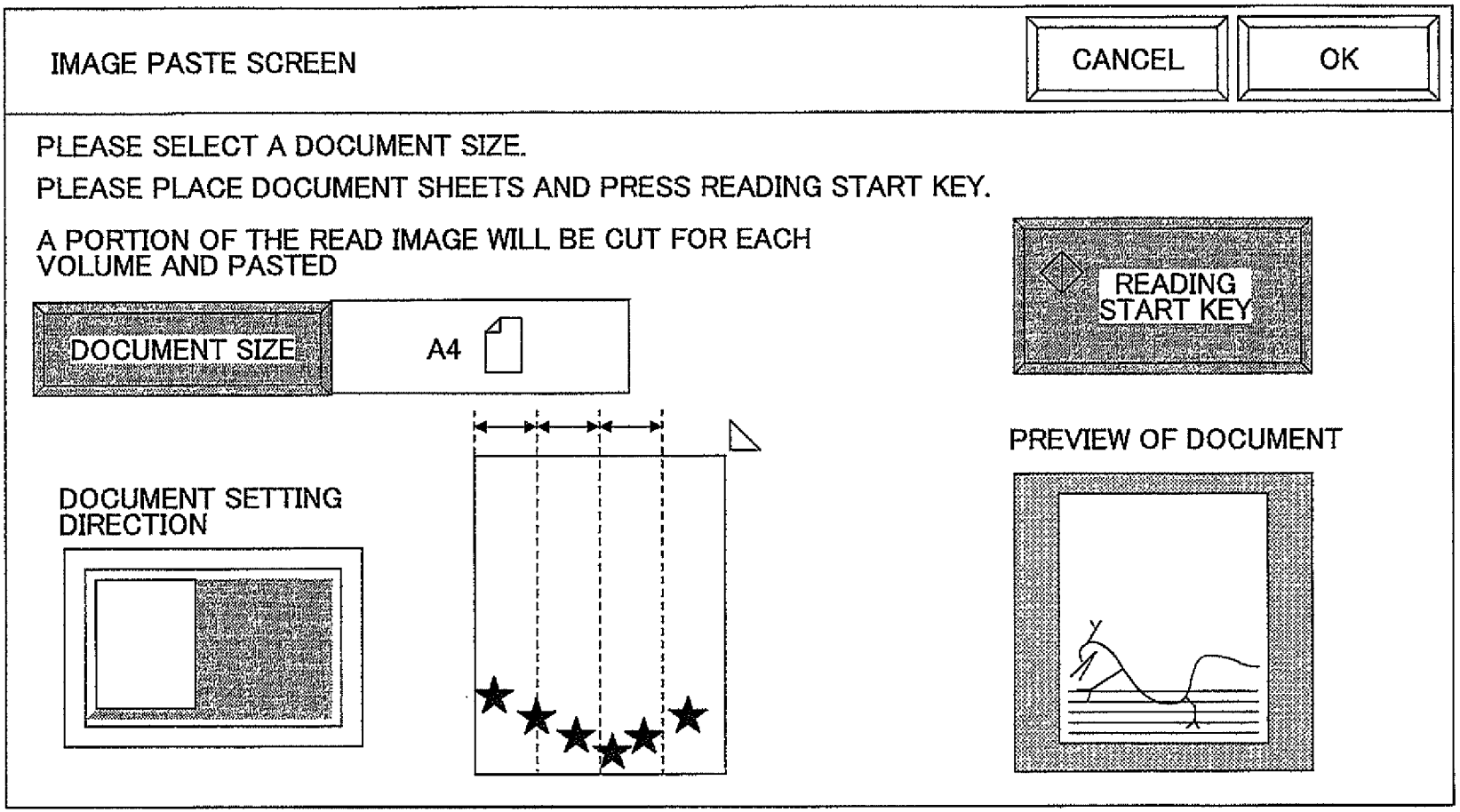
FIG. 18 is a diagram showing an example of an image paste screen.

FIG. 18 is a diagram showing an example of the image paste screen. As shown in FIG. 18, the size of an image document to be attached to the spines of the volumes and the document setting direction are specified by the operator in the image paste screen. Next, if the operator presses the reading start key, reading of the document image for the spines is performed.

At the end of reading of the document image, the images of the spines and the document image divided for every volume are displayed in the document preview region as shown in FIG. 18. At this time, the read image data is stored in the image memory 39.

The wrap bookbinding printing is performed after the images of the spines are determined (the execution of the wrap bookbinding printing is the same as that of the previous embodiment). Then, a partial image for the spine cover is cut from the read images of the spines, and it is printed to the spine cover. At this time, logging of the image printed on a spine is performed for every separate volume, and read-out of an image is performed from image memory 39 each time.

For every separate volume, the width of a spine is detected, data is written to the register of the memory controller 38, the image equivalent to the width detected about the image of the spine is cut, and the obtained image data is transmitted to the writing unit 37. The writing unit 37 prints the image data to the spine cover.

Figure 19A:
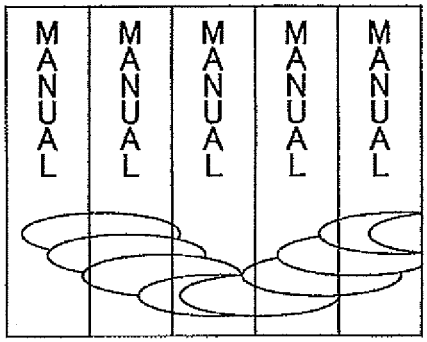
FIG. 19A, FIG. 19B, FIG. 19C and FIG. 19D are diagrams showing examples of the image printed on spine covers.
Figure 19B:
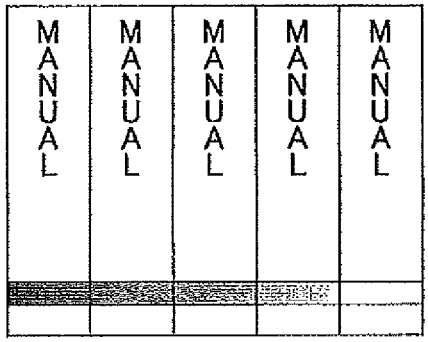

FIGS. 19A to 19D are diagrams showing examples of images printed on spine covers. FIG. 19A is a diagram showing an example of the image in which a series of images for every spine width are cut and printed to each spine cover. FIG. 19B is a diagram showing an example of the image with a gradually changed color which is printed to each spine cover.

Figure 19C:
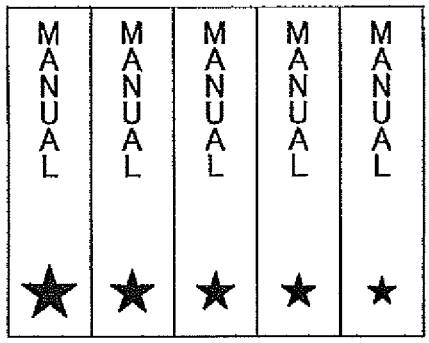
Figure 19D:
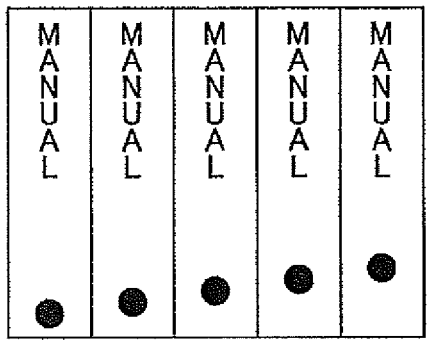

FIG. 19C is a diagram showing an example of the image in which the images printed to the spine covers are gradually changed in size (smaller or larger). FIG. 19D is a diagram showing an example of the image in which the positions of the images printed to the spine covers are gradually shifted up (or down).

As for FIG. 19C and FIG. 19D, it is not necessary to detect the spine width, but it is necessary to store the size or position of the image printed to the spine of the last volume.

As for FIG. 19B, the case where the color is changed for every volume, and the case where the color is gradually changed regardless of the volume can be considered. In each case, it is necessary to store the color of the image printed to the spine of the last volume.

Figure 20:
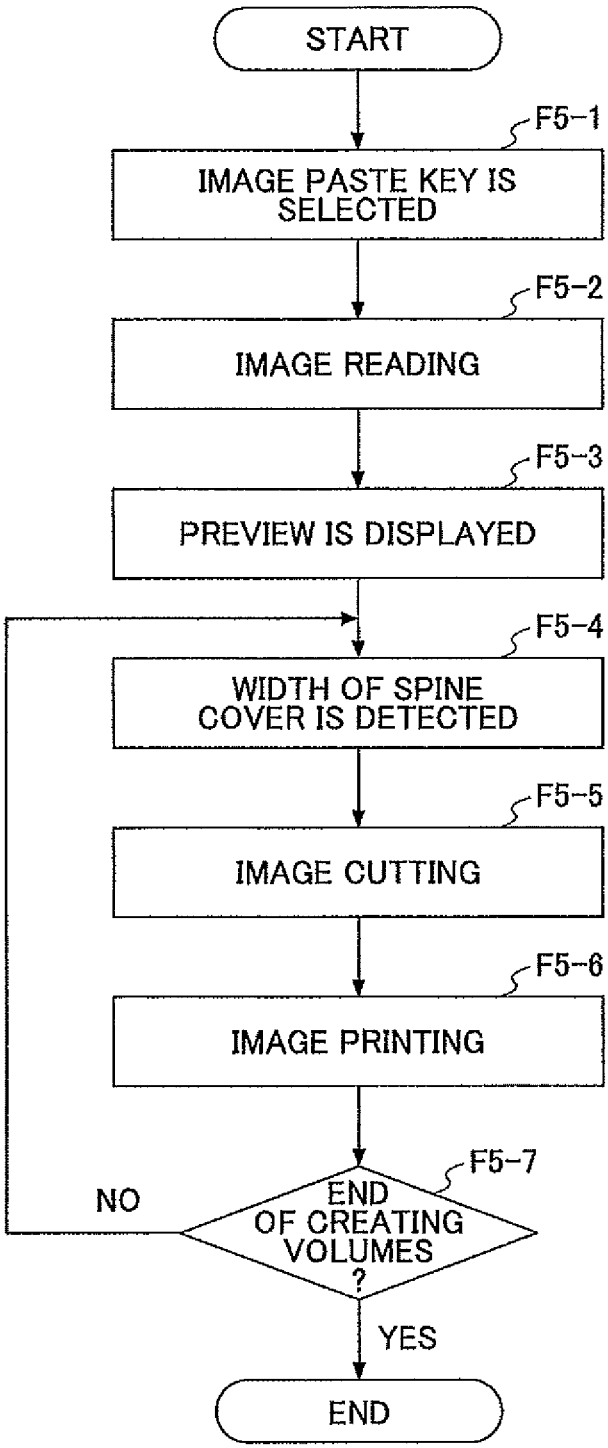
FIG. 20 is a flowchart for explaining an example of a process which pastes an image to a spine cover.

FIG. 20 is a flowchart for explaining an example of the process which pastes an image to a spine. The process shown in FIG. 20 is arranged so that an image is read, a partial image for a spine width is cut from the read image, and the partial image is pasted to the spine of a volume (printing).

In step F5-1, the image paste key P2-5 is chosen from the spine cover printing screen as shown in FIG. 17 by the operator, and the image reading request is output to the image reading unit (the scanner device).

In step F5-2, the image reading unit reads the image of a document set in the image forming device.

In step F5-3, the read image is displayed on the display screen as a preview.

In step F5-4, the width detection unit detects the width of a spine cover from the number of recording sheets included in the volume created.

In step F5-5, the image logging unit (equivalent to the operation control unit 3) cuts a partial image equivalent to the detected width of the spine cover.

In step F5-6, the printing unit 4 prints the cut image to the spine cover.

Next, in step F5-7, the wrap bookbinding unit 5 determines whether the end of the process of creating the volumes takes place. When the result of the determination at the step F5-7 is affirmative, the process of FIG. 20 is terminated. When the result of the determination at the step F5-7 is negative, the control is transferred to the step F5-4 and the steps F5-4 to F5-7 are repeated until the end of the process of creating the volumes takes place.

The process of FIG. 20 is performed as described above, and the relationship of the volumes created can be easily recognized from the image (selected by the user) printed to the spines of the volumes. For example, when the volumes are not arranged in the wrong sequence which does not match with the sequence of creating the volumes, the series of images of the spines are not arranged in the right sequence. Such arrangement of the volumes in the wrong sequence can be easily recognized. Also, rearranging the volumes correctly can be easily performed.

In the above embodiment, the detection of the width of the spine cover in step F5-4 is performed every time a volume is created by the wrap bookbinding unit 5. Alternatively, before performing the wrap bookbinding, the volumes of recording sheets may be created and the width of the spine cover of each volume may be stored. In such a case, the step F5-3 may be modified so that the images of the volumes created are displayed as a preview based on the widths of the detected spines.

Detecting the width of an actual spine cover is not necessarily required when displaying the images of the volumes as a preview. Assuming that the widths of the spine covers are determined based on a predetermined thickness threshold value (the maximum binding number of sheets), the images of the volumes created may be displayed based on the determined widths. Thus, the user views the images of the actually divided image data, and if they differ from the desired one, the user can cancel them and return to the start of the process.

Next, the variation in the case of printing an image on spine covers will be described with reference to FIGS. 21A to 23E.

FIGS. 21A to 21D are diagrams showing an example of printing a reduced image on spine covers. FIG. 21A shows the example in which a recording sheet used for performing the wrap bookbinding is divided into four items (spine covers), and FIG. 21B shows the image which is to be printed on the spine covers.

FIG. 21C shows a reduced image, and FIG. 21D shows the example in which the reduced image is printed to the spine covers of the respective volumes.

The example of FIG. 21A-FIG. 21D is arranged so that the wrap bookbinding is performed after all the spine covers are created from the recording sheet. It is not intended to perform the wrap bookbinding every time one of the volumes is created.

As shown in FIGS. 21A and 21B, when the width of the initial image is larger than the sum of the widths of the volumes created, printing the non-reduced image on the spine covers will cause some portion of the image to disappear in the intermediate position. To avoid the problem, as shown in FIG. 21C, the initial image is reduced in size so that the width of the reduced image is less than the sum of the widths of the volumes created.

Next, as shown in FIG. 21D, a partial image which is equivalent to the width of each volume is cut from the reduced image, and the partial image is printed on the spine of each volume.

Accordingly, it is possible to prevent some portion of the image printed on the spine covers from disappearing in the intermediate position, and the visibility of the image indicating the relationship of the volumes can be improved.

FIGS. 22A to 22C are diagrams showing an example of printing an image on spine covers repeatedly. FIG. 22A shows the example in which a recording sheet used for performing the wrap bookbinding is divided into four items (spine covers), FIG. 22B shows the image to be printed on spine covers, and FIG. 22C shows the example in which the image was repeatedly printed on the spine of each volume.

As shown in FIGS. 22A and 22B, when the width of the initial image is smaller than the sum of the widths of the volumes created, cutting partial images from the initial image and printing them on the spine covers without change will cause a loss of the printing image data in the intermediate position. The relationship of the volumes will not be clear in subsequent volumes.

To solve this problem, as shown in FIG. 22C, the image is printed on the spine covers repeatedly. Thus, it is possible to prevent the loss of the printing image data in the intermediate position, and the relationship of the volumes created can be easily recognized from the images printed on the spine covers.

Alternatively, in the case of FIGS. 22A and 22B, the initial image may be expanded and the expanded image may be printed on the spine covers. In this case, the image reduction step as shown in FIG. 21C may be replaced by the image expansion step and other steps may be performed in a similar manner.

FIGS. 23A to 23E are diagrams showing an example of printing an image on a cover sheet including spine covers at a shifted printing position. FIGS. 23A and 23B are the same as FIGS. 21A and 21B. FIG. 23C shows an example of a cover sheet used to wrap a batch of recording sheets in the first volume, FIG. 23D shows an example of a cover sheet used to wrap a batch of recording sheets in the second volume, and FIG. 23E shows an example of the volumes wherein the image is printed on the spine of each volume and the volumes are arranged in order.

As shown in FIGS. 23C and 23D, the cutting of a partial image is not performed, but the printing position of the image to the spine cover is shifted for each volume, and the relationship of the volumes is maintained. In this case, it is necessary to store a printing position P indicating the position where the image is printed in the start position of the spine cover, and a width W of the spine cover of the last volume.

In the example of FIGS. 23A to 23E, when printing an image on a cover sheet (including a front cover, a spine cover, and a back cover), the printing position P of the spine cover in the image is shifted in the direction to the back cover by the width W of the spine cover so that the shifted printing position P and the start position of the spine cover are in agreement, and the image is printed on the cover sheet. The volumes for which the image is thus printed on the spine of each volume and the volumes are arranged in order is shown in FIG. 23E.

As shown in FIG. 23E, the cutting of a partial image is not performed, but the process is performed so that the image is printed on the cover of each volume at the shifted printing position. In this manner, the same advantage can be acquired as for the case where the cutting of a partial image is performed.

When the wrap bookbinding is performed to create plural volumes, it is necessary to store the number of volumes at the time of creating the first volume, the width of the spine cover of each volume, and the cut-away image. Thereby, at the time of creating the second volume, it is not necessary to detect the width of a spine cover again and cut a partial image for every bookbinding step.

The image forming system of the embodiment of the invention described above has the following advantages:

(1) A volume number is printed on a cover of each volume when the volumes are created, and the relationship of the volumes created can be easily recognized. The relationship of the volumes can be recognized from the volume number printed on the spine cover of each volume even when the volumes are stacked on a bookshelf and the front cover and the back cover of each volume cannot be seen, and the ease of inspection improves.

(2) Both a chapter number and a volume number are printed on a cover of each volume at the time of the chapter separation mode, and the relationship of the chapters and the volumes can be recognized. The relationship of the chapters and the volumes can be recognized from the chapter number and the volume number printed on the spine cover of each volume even when the volumes are stacked on a bookshelf and the front cover and the back cover of each volume cannot be seen, and the ease of inspection improves.

(3) When the thicknesses of the volumes created have variations and the title characters are printed on the spine covers of all the volumes are of the same size, the title characters may be protruded to the front cover or the back cover. In the present embodiment, the title characters are not printed on the spine cover of a thin volume which has a thickness smaller than the size of the printing characters, and the above-mentioned problem can be avoided.

(4) When the volumes for each chapter are created, creating two or more volumes including a small number of sheets can be prevented. When viewing of a document is performed for each chapter, the number of volumes which should be viewed can be reduced and the ease of inspection for every chapter can be increased.

(5) When separate volumes are created, an image indicating the relationship of the volumes (for example, the sequence of bookbinding) is printed on the spine cover of each volume. The relationship of the volumes can be recognized from the image even when the volumes are stacked on a bookshelf and the front cover and the back cover of each volume cannot be seen, and the ease of inspection improves.

The present invention is not limited to the specifically disclosed embodiments, and variations and modifications may be made without departing from the scope of the present invention.

The printing control method of the embodiment of the invention may be carried out by a computer of the image forming system which reads a computer-readable program from the memory unit of the image forming system and executes the program. The above-described process performed by the image forming system of the embodiment of the invention is defined in the program stored in the memory unit of the image forming system.

The computer-readable recording medium storing the computer-readable program of the embodiment of the invention may be implemented in the image forming system of the embodiment of the invention to perform the printing control method of the embodiment of the invention. When the computer-readable program is read from the computer-readable recording medium and executed by the computer of the image forming system, the computer-readable program causes the computer to perform the printing control method of the embodiment of the invention. The above-described process performed by the image forming system of the embodiment of the invention is defined in the program stored in the recording medium of the image forming system.

The present application is based on Japanese patent application No. 2007-270547, filed on Oct. 17, 2007, and Japanese patent application No. 2008-237131, filed on Sep. 16, 2008, the contents of which are incorporated herein by reference in their entirety.

What is claimed is:

1. An image forming system including a printing unit which prints an image on a recording sheet, and a wrap bookbinding unit which performs wrap bookbinding of a batch of recording sheets including a plurality of document sheets on which images are printed by the printing unit, the image forming system comprising:

a thickness detection unit configured to detect a thickness of a batch of recording sheets stacked on a tray of the wrap bookbinding unit;

a wrap bookbinding control unit configured to cause, when the thickness of the batch of recording sheets detected by the thickness detection unit exceeds a binding thickness threshold value corresponding to a maximum binding number of recording sheets of the wrap bookbinding unit, the wrap bookbinding unit to perform wrap bookbinding to create one or a plurality of volumes in each of a plurality of chapters;

a relevant information printing control unit configured to cause the printing unit to print an image of relevant information, indicating a relationship of the plurality of volumes and the plurality of chapters, on a cover sheet used to wrap each volume; and a determining unit configured to determine a k-th volume binding number of recording sheets to be created for a k-th volume of the volumes in an x-th chapter of the chapters, and characters indicating a chapter number and a volume number to be printed for the k-th volume, wherein, each time the k-th volume binding number of recording sheets for the k-th volume is reached, the wrap bookbinding control unit causes the wrap bookbinding unit to perform the wrap bookbinding to create the k-th volume and causes the printing unit to print the characters indicating the chapter number and the volume number on a spine of a cover sheet for the k-th volume.

2. The image forming system according to claim 1, wherein the relevant information printing control unit comprises a number printing control unit configured to cause the printing unit to print the characters as the relevant information on the cover sheet for each volume.

3. The image forming system according to claim 1, further comprising:

an operation unit configured to receive setting information or instructions input by an operator, wherein, when the operation unit receives the setting information which selects a chapter/volume number printing format and sets a chapter separation mode, the relevant information printing control unit causes the printing unit to print, on the spine of the cover sheet for each volume, the characters determined by the determining unit; and a computing unit configured to compute a number of surplus sheets by dividing a number of pages of each chapter by the maximum binding number when the operation unit receives the setting information, wherein the determining unit is further configured to determine whether the surplus sheets, the number of which is computed by the computing unit, are to be included in a final volume of an (x−1)-th chapter.

4. The image forming system according to claim 1, wherein the relevant information printing control unit comprises an image printing control unit configured to cause the printing unit to print an image on a cover sheet for each volume indicating a sequence of the volumes as the relevant information.

5. The image forming system according to claim 4, further comprising a width detecting unit configured to detect a width of a spine cover for each volume, wherein the image printing control unit is configured to cut from the image a partial image equivalent to the width of the spine cover detected by the width detecting unit, and to cause the printing unit to print the partial image on the spine cover for each volume.

6. The image forming system according to claim 5, further comprising an operation unit configured to receive setting information or instructions input by an operator, wherein the image printing control unit is configured to cause, when the operation unit receives the setting information which sets a chapter separation mode and a sum of widths of spine covers of volumes contained in a chapter is larger than a width of the image, the printing unit to print the image on the spine covers of the volumes repeatedly.

7. The image forming system according to claim 6, wherein, when the sum of the widths is smaller than the width of the image, the image printing control unit creates a reduced image having a width equivalent to the sum of the widths, cuts from the reduced image a partial image equivalent to a width of each spine cover, and causes the printing unit to print the partial image on the spine cover.

8. The image forming system according to claim 4, further comprising:

a width detecting unit configured to detect a width of a spine cover for each volume; and a memory unit configured to store the width of the spine cover detected by the width detecting unit, and a spine cover printing position indicating a position where the image is printed at a starting position of the spine cover, wherein the image printing control unit shifts the spine cover printing position in a direction of a back cover by the width of the spine cover stored in the memory unit, so that the shifted spine cover printing position and the starting position of the spine are in agreement, and causes the printing unit to print the image on a cover sheet for each volume.

9. A printing control method for use in an image forming system including a printing unit which prints an image on a recording sheet, and a wrap bookbinding unit which performs wrap bookbinding of a batch of recording sheets including a plurality of document sheets on which images are printed by the printing unit, the printing control method comprising:

detecting a thickness of a batch of recording sheets stacked on a tray of the wrap bookbinding unit;

causing, when the detected thickness of the batch of recording sheets exceeds a binding thickness threshold value corresponding to a maximum binding number of recording sheets of the wrap bookbinding unit, the wrap bookbinding unit to perform wrap bookbinding to create one or a plurality of volumes in each of a plurality of chapters;

causing the printing unit to print an image of relevant information, indicating a relationship of the plurality of volumes and the plurality of chapters, on a cover sheet used to wrap each volume; and determining a k-th volume binding number of recording sheets to be created for a k-th volume of the volumes in an x-th chapter of the chapters, and characters indicating a chapter number and a volume number to be printed for the k-th volume, wherein, each time the k-th volume binding number of recording sheets for the k-th volume is reached, the wrap bookbinding unit is caused to perform the wrap bookbinding to create the k-th volume and the printing unit is caused to print the characters indicating the chapter number and the volume number on a spine of a cover sheet for the k-th volume.

10. A non-transitory computer-readable recording medium storing a computer-readable program which, when executed by a computer of an image forming system, causes the computer to perform a printing control method, the image forming system including a printing unit which prints an image on a recording sheet, and a wrap bookbinding unit which performs wrap bookbinding of a batch of recording sheets including a plurality of document sheets on which images are printed by the printing unit, the printing control method comprising:

detecting a thickness of a batch of recording sheets stacked on a tray of the wrap bookbinding unit;

causing, when the detected thickness of the batch of recording sheets exceeds a binding thickness threshold value corresponding to a maximum binding number of recording sheets of the wrap bookbinding unit, the wrap bookbinding unit to perform wrap bookbinding to create one or a plurality of volumes in each of a plurality of chapters;

causing the printing unit to print an image of relevant information, indicating a relationship of the plurality of volumes and the plurality of chapters, on a cover sheet used to wrap each volume; and determining a k-th volume binding number of recording sheets to be created for a k-th volume of the volumes in an x-th chapter of the chapters, and characters indicating a chapter number and a volume number to be printed for the k-th volume, wherein, each time the k-th volume binding number of recording sheets for the k-th volume is reached, the wrap bookbinding unit is caused to perform the wrap bookbinding to create the k-th volume and the printing unit is caused to print the characters indicating the chapter number and the volume number on a spine of a cover sheet for the k-th volume.

* * * * *